US012258193B2

(12) United States Patent
Deliou

(10) Patent No.: US 12,258,193 B2
(45) Date of Patent: Mar. 25, 2025

(54) METHOD AND SYSTEM FOR PROVIDING A FLUID PRODUCT MAILER

(71) Applicant: BOEHRINGER INGELHEIM VETMEDICA GMBH, Ingelheim am Rhein (DE)

(72) Inventor: Pierre-Emmanuel Deliou, Sugar Hill, GA (US)

( * ) Notice: Subject to any disclaimer, the term of this patent is extended or adjusted under 35 U.S.C. 154(b) by 15 days.

(21) Appl. No.: 18/170,122

(22) Filed: Feb. 16, 2023

(65) Prior Publication Data

US 2023/0312207 A1 Oct. 5, 2023

Related U.S. Application Data

(60) Provisional application No. 63/268,148, filed on Feb. 17, 2022.

(51) Int. Cl.
*B65D 75/22* (2006.01)
*B65D 83/00* (2006.01)

(52) U.S. Cl.
CPC ..... *B65D 75/225* (2013.01); *B65D 83/00* (2013.01); *B65D 2203/06* (2013.01)

(58) Field of Classification Search
CPC .. B65D 75/225; B65D 83/00; B65D 83/0055; B65D 27/005; B65D 75/245; B65D 2203/06
USPC ..... 229/71, 304, 316; 206/763, 750, 730, 206/733, 462, 461, 779, 766, 471, 464, 206/775; 222/81
See application file for complete search history.

(56) References Cited

U.S. PATENT DOCUMENTS 3,352,409 A * 11/1967 Link ..... B65D 75/30 206/463
4,923,063 A * 5/1990 Tararuj ..... B65D 75/5833 206/484
5,039,000 A * 8/1991 Ashby ..... B65D 27/06 229/69
6,213,303 B1 * 4/2001 Harris ..... A45D 40/0087 206/466
6,230,964 B1 * 5/2001 Saito ..... B65D 75/327 206/463
6,409,079 B1 * 6/2002 Hutchinson ..... B65D 27/06 229/92.1
7,021,458 B2 * 4/2006 Cummings ..... B65D 77/0413 229/162.1
10,065,767 B1 9/2018 Bludorn
2003/0024851 A1 * 2/2003 Auclair ..... B65D 5/5016 206/592

(Continued)

FOREIGN PATENT DOCUMENTS

FR 2975977 A1 12/2012

OTHER PUBLICATIONS

English Abstract of FR2975977.

*Primary Examiner* — Rafael A Ortiz

(57) ABSTRACT

The assembly (1) has a plastic sachet (2) containing cosmetic product and enclosed within a paper card (3), where the sachet includes a wall and another wall (5*b*) with an annular attachment (6) and an opening unit (7), respectively. The card includes two walls (8*a*, 8*b*) with a closure device (9) and an opening unit (11). An adhesive fixes the sachet on the card, so that the assembly with the cosmetic product is generally planar so as to be collected, handled, transported, stored and distributed by mail while preserving integrity of the sachet and the dose of fluid product.

17 Claims, 25 Drawing Sheets

(56) References Cited

U.S. PATENT DOCUMENTS

| | | | | |
|---|---|---|---|---|
| 2010/0125097 | A1* | 5/2010 | Soll | A61K 47/14<br>206/570 |
| 2014/0091003 | A1* | 4/2014 | Bradfield | B65D 75/02<br>206/461 |
| 2018/0354683 | A1* | 12/2018 | Bludorn | B65D 75/38 |

* cited by examiner

METHOD AND SYSTEM FOR PROVIDING A FLUID PRODUCT MAILER

CROSS REFERENCE TO RELATED APPLICATIONS

This application claims the benefit of priority to U.S. Provisional Application No. 63/268,148 filed on Feb. 17, 2022, which is incorporated herein by reference in its entirety.

INCORPORATION BY REFERENCE

All references cited herein are incorporated by reference in their entirety.

BACKGROUND

The cost of shipping products can be a significant expense for most product manufacturers. When the cost of shipping a product approaches close to and/or exceeds twenty percent (20%) of a product's retail price, such a cost may substantially erode potential profits for the product manufacturer. Often, product manufacturers use private shipping carriers (i.e. United Parcel Service [UPS], FedEx, DHL, etc.) since private shipping carriers may provide door-to-door service.

In the United States, private shipping carriers usually charge three to five times or more in shipping costs compared to the First-Class mail rate set by the United States (U.S.) Postal Service (USPS). Generally, private shipping carriers charge more fees to deliver products to a consumer's doorstep because private shipping carriers are not permitted to deliver products in U.S. Postal Service mailboxes.

Meanwhile, product manufacturers may significantly reduce their shipping costs compared to private shipping carriers if they can use the USPS with its First-Class mail rate and provide packages which are "machinable" as defined by the USPS. The first class mail rate (as of this writing) is $0.42 for 1.0 ounce, and $0.17 for each additional ounce as of this writing. [See https://about.usps.com/postal-bulletin/2007/html/pb22218/kit1_010.html].

The maximum size for "machinable" letters at the USPS First-Class mail rate is as follows, in terms of Length×Width and thickness: 11½"×6⅛"×¼" thick. When a piece of USPS First-Class Mail exceeds any one of the maximum measurements of a letter, it is classified and priced as a large envelope (flat) rate. The maximum weight for letter-size pieces at the USPS First-Class rate is 3.5 ounces (weight).

The USPS defines common nonmachinable characteristics as follows: the aspect ratio (length divided by height) is less than 1.3 or more than 2.5; the mail piece is rigid or contains odd-shaped items; the delivery address is parallel to the shorter dimension of the mail piece; the mail piece measures more than 6" long or 4¼" high, if the thickness is less than 0.009".

The non-rigid requirement for machinable First-Class mail pieces is significant. The USPS has this non-rigid requirement since the sorting machines used by the USPS have metal drums each with about a 5.5 inch radius. First-Class mail pieces are "non-rigid" if they can be bent around these metal drums and conform to their shape having this 5.5 inch radius.

A product manufacturer meeting USPS First-Class mailing requirements presents a unique set of variables to solve for shipping its products under this cost-efficient service. The set of variables is further complicated if the product manufacturer has a fluid type of product to ship. If a fluid type product needs to be shipped via USPS First-Class mail, the container holding the fluid must also meet these stringent requirements in addition to preventing any leaking of the fluid from the container.

Accordingly, there is a need in the art for a method and system for creating a fluid product mailer which meets the stringent requirements set by the USPS for its First-Class rate. Thus, there is a need in the art for a fluid product mailer which is compact and is flexible so that it is "machinable" by the USPS, or can be processed without human intervention during the mailing or sorting process.

SUMMARY

A method and system provides a folded mailer system which can house/enclose a container which houses a liquid. The folded mailer system meets the requirements/standards as set forth by the USPS for first-class machinable mail. While the folded mailer system meets the USPS requirements/standards for first-class machinable mail, the folded mailer system may also meet the requirements/standards for machinable mail in other jurisdictions outside of the United States, such as, but not limited to, the United Kingdom, Germany, France, Spain, Italy, Netherlands, Belgium, Australia, Japan, China, Taiwan, the Russian Federation, etc, etc.

A mailer system may include a container capable of holding a liquid and a structure for holding the container when the container is shipped. The structure may have at least two sections which are folded on to each other when the container is shipped. The container and structure may be machinable within an automated mailing system.

One section of the structure may have an aperture for receiving the container. The structure may also have a third section which is folded over the first and second sections. The structure may comprise a tri-folded arrangement when the container and structure are shipped. Each section of the structure may have removable portions that are detached after the container and structure are shipped such that the container may be removed from the structure. The container may have a fluid outlet. The container may hold fluid comprising at least one of: a fragrance, a pheromone, a cosmetic treatment, a pharmaceutical composition, an insecticide or a parasiticide composition for treating an animal, including humans. The container may also have a bottom plate. The structure of the system may comprise a planar sheet. The planar sheet may comprise a plurality of layers.

According to another exemplary embodiment, the mailer system may include a folded planar member; and a container that is attached to the folded planar member. The container may enclose a fluid. The mailer system may be machinable by an automated mailing system which uses at least one drum that bends the mailer system around the drum.

The fluid within the container may comprise a topical composition for the treatment or prevention of an ectoparasitic infestation in animals. The ectoparasites comprise at least one of fleas, ticks, chewing lice, and mange. The fluid may comprise at least one of a: fragrance, pheromone, cosmetic treatment for use in companion animals or an insecticide or parasiticide.

The folded planar member may comprise a plurality of layers. One layer may comprise at least one of cardboard, varnish, and a plastic film.

According to another exemplary embodiment, a mailer system may include a folded planar member; and a container that is attached to the folded planar member. The container may enclose a fluid. The folded planar member may further comprise an aperture for receiving the container. The mailer system may be machinable by an automated mailing system which uses at least one drum that bends the mailer system around the drum.

This summary is provided to introduce a selection of concepts that are further described below in the detailed description and illustrated in the several detailed figures. This summary is not intended to identify key or essential features of the claimed subject matter, nor is it intended to be used as an aid in limiting the scope of the claimed subject matter.

BRIEF DESCRIPTION OF THE DRAWINGS

In the drawings, like reference numerals refer to like parts throughout the various views unless otherwise indicated. For reference numerals with letter character designations such as "102A" or "102B", the letter character designations may differentiate two like parts or elements present in the same figure. Letter character designations for reference numerals may be omitted when it is intended that a reference numeral to encompass all parts having the same reference numeral in all figures. For clarity, not all components are shown in each Figure.

The word "exemplary" is used herein to mean "serving as an example, instance, or illustration." Any aspect described herein as "exemplary" is not necessarily to be construed as exclusive, preferred or advantageous over other aspects.

DETAILED DESCRIPTION OF EXEMPLARY EMBODIMENTS

Figure 1:
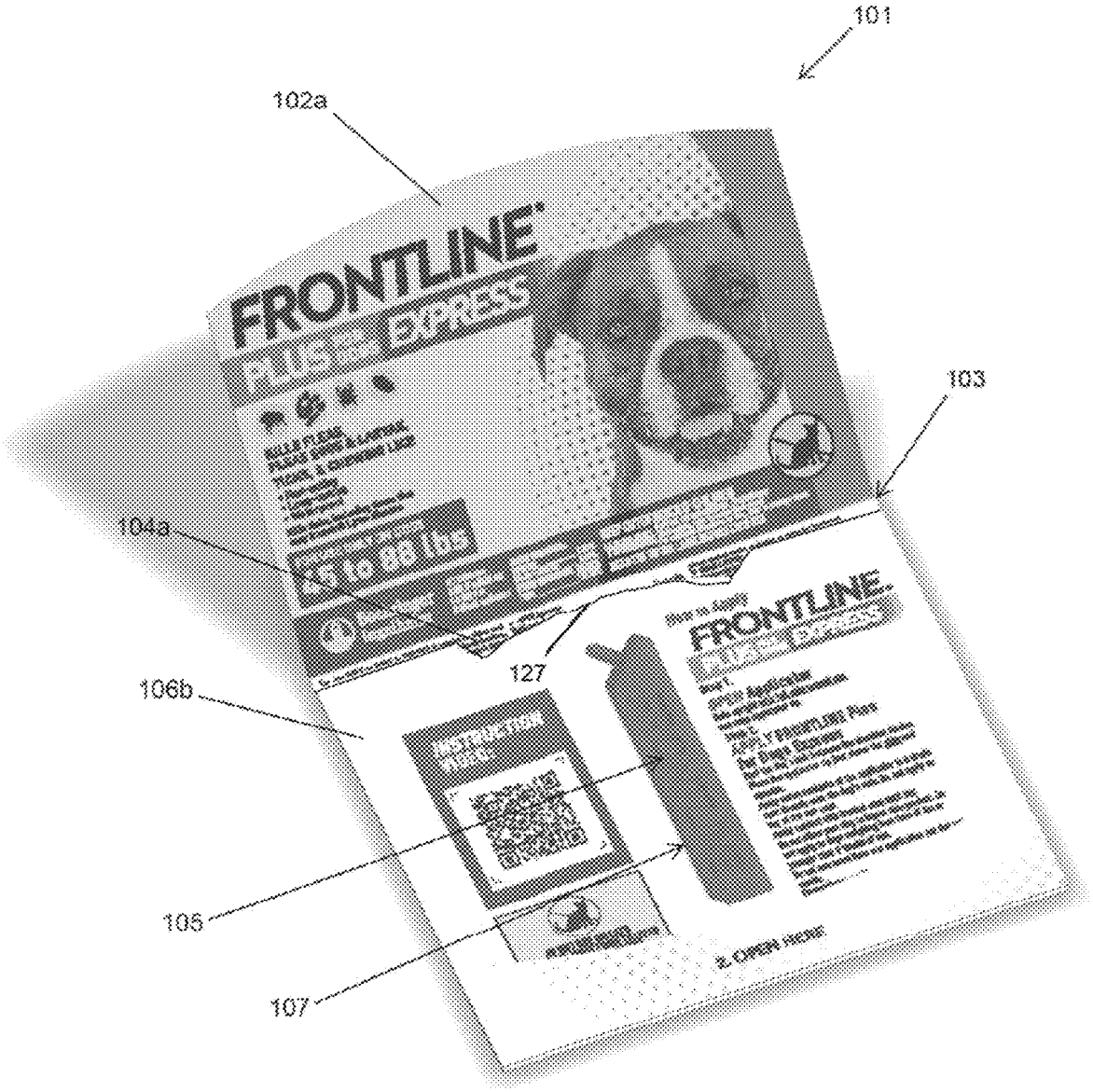
FIG. 1 illustrates a perspective view of a mailer system in a partially-opened state which comprises a folded structure according to one exemplary embodiment.
Figure 2:
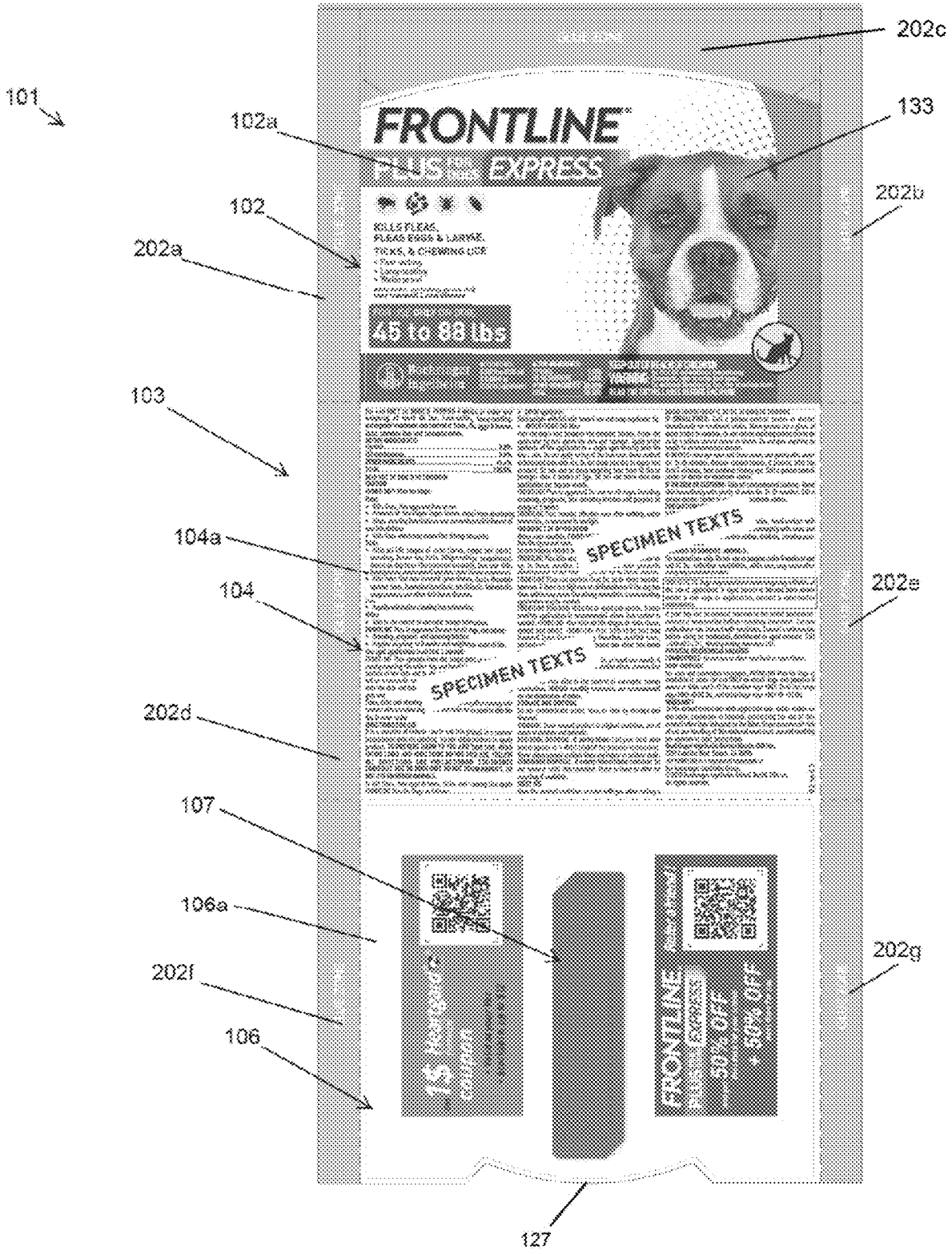
FIG. 2 illustrates the mailer system in fully opened or unfolded state where the three sections are substantially parallel to one another and where the front sides of the sections are visible.

Referring now to FIG. 1, this figure illustrates a perspective view of a mailer system 101 in a partially-opened state which comprises a folded structure 103 according to an exemplary embodiment of the system 101. The folded structure 103 has a first planar section 102, a second planar section 104, and a third planar section 106. In FIG. 1, a first side 102*a* of the first planar section 102 is visible while only a small portion of a front side 104*a* of the second planar section 104 can be seen. A rear side 106*b* of the third planar section 106 blocks or is covering most of the front side 104*a* of the second planar section 104. This rear side 106*b* has a curved edge 127 that is also illustrated in FIG. 2 described below.

The third planar section 106 has an aperture 107 which has a shape that substantially mirrors the shape of a container 105. The container 105 may house or contain a fluid according to one exemplary embodiment. However, the container may house solids or semi-solid substances as will be described below.

When in fluid form, the fluid may comprise a topical composition for the treatment or prevention of ectoparasitic infestation and/or infection in animals (i.e. treating and/or preventing fleas, ticks, chewing lice, mange and/or nematode and filarial worms in companion animals). In one embodiment, the animal may be a companion animal. Companion animals may include, but are not limited to, dogs and cats. However, other types of dosage forms are possible and are included within the scope of this disclosure, where some are described in detail below.

Other fluids within the container 105 may comprise a fragrance for humans, a pheromone, a cosmetic treatment, an insecticide, a pharmaceutical composition, or other fluids for various uses, etc. Further, as noted above, the container 105 may envelope or house objects other than fluids. For example, the container 105 may house a soft chewable composition, pills/medicine, gels, lotions, pastes, an electronic chip such as a transponder for a companion animal, or a memory chip for a personal computing device (i.e. wireless phone, laptop, camera, etc.).

In other embodiments, the container 105 may hold other, various types of pharmaceutical compositions and dosage forms. For example, in one exemplary embodiment, the container 105 may hold pharmaceutical compositions comprising an effective amount of at least one active ingredient, or salts thereof, in combination with an acceptable carrier or diluent. The pharmaceutical compositions may be in a variety of liquid and solid forms which are suitable for various methods of application or administration to an animal.

As another example, the pharmaceutical compositions may comprise one or more active ingredients which may be in compositions suitable for oral administration, injectable administration, including subcutaneous and parenteral administration, topical administration (e.g. spot-on or pour-on), including dermal or subdermal administration. It will be understood by one of ordinary skill in the art that the shape and size of the dosage form may be adapted to be included in the container 105 of the present invention.

Suitable topical spot-on or pour-on pharmaceutical compositions may comprise a pharmaceutically effective amount of at least one active ingredient in a pharmaceutically acceptable carrier or diluent. The pharmaceutically acceptable carrier or diluent for the topical compositions may include, but are not limited to, solvents and solvent mixtures, permeation enhancers, surfactants, antioxidants, pH stabilizers, preservatives and crystallization inhibitors known in the art.

In other exemplary embodiments, the container 105 may hold a composition suitable for oral administration to an animal. Suitable dosage forms for oral administration include dietary supplements, troches, lozenges, chewables (e.g. chewable tablets or soft chews), tablets, hard or soft capsules, boluses, emulsions, aqueous or oily suspensions, aqueous or oily solutions, oral drench compositions, dispersible powders or granules, premixes, syrups or elixirs, enteric compositions or pastes. In one embodiment, a flat-rollable-chewable paste or gum for oral administration may be included in the container. The size and shape of the flat-rollable-chewable paste may be adapted to fit the size and shape of the container 105. Pharmaceutical compositions intended for oral use may be prepared according to any method known in the art for the manufacture of pharmaceutical compositions. Suitable tablets may be obtained, for example, by mixing one or more active agents with known excipients, for example inert diluents, carriers, disintegrants, adjuvants, surfactants, binders and/or lubricants.

In another exemplary embodiment of the invention, a soft chewable veterinary composition may be provided in the container 105 that comprises an effective amount of at least one active agent in a pharmaceutically acceptable carrier.

The container 105 may include a variety of active agents and combinations of active agents together with pharmaceutically acceptable carriers or diluents. In one embodiment, the active ingredient may include one or more arylpyrazole compounds, such as a phenylpyrazole insecticide known in the art. Phenylpyrazole insecticides act by blocking glutamate-activated chloride channels (GABAA gated chloride) in insects. Examples of such phenylpyrazole compounds include but are not limited to those described in U.S. Pat. Nos. 6,001,384; 6,010,710; 6,083,519; 6,096,329; 6,174,540; 6,685,954 and 6,998,131 (all incorporated herein by reference). One particular phenylpyrazole compound that may be included is fipronil.

In another embodiment of the invention, one or more macrocyclic lactones, which act as an acaricide, anthelmintic agent and/or insecticide, can be included in the container 105. Macrocyclic lactones include both avermectins and milbemycins active agents. Avermectins include, but are not limited to, abamectin, dimadectin, doramectin, emamectin, eprinomectin, ivermectin, latidectin, lepimectin and selamectin. Milbemycins include, but are not limited to, milbemectin, milbemycin D, milbemycin oxime, moxidectin and nemadectin. Also included are the 5-oxo and 5-oxime derivatives of said avermectins and milbemycins.

In another embodiment, the active agent within the container 105 may be one or more molecules of a class of insecticides known as insect growth regulators (IGRs). Compounds belonging to this group are well known to the practitioner and represent a wide range of different chemical classes. These compounds all act by interfering with the development or growth of the insect pests. Insect growth regulators are described, for example, in U.S. Pat. Nos. 3,748,356, 3,818,047, 4,225,598, 4,798,837, 4,751,225, EP 0 179 022 or U.K. 2 140 010 as well as U.S. Pat. Nos. 6,096,329 and 6,685,954 (all incorporated herein by reference).

In one embodiment, the container 105 may include an IGR that mimics juvenile hormone (juvenile hormone mimic). Examples of juvenile hormone mimics include, but are not limited to, azadirachtin, diofenolan, fenoxycarb, hydroprene, kinoprene, (S)-methoprene, pyriproxyfen, tetrahydroazadirachtin and 4-chloro-2 (2-chloro-2-methyl-propyl)-5-(6-iodo-3-pyridylmethoxy)pyridazine-3 (2H)-one.

In another embodiment, the IGR compound within the container 105 may comprise a chitin synthesis inhibitor. Chitin synthesis inhibitors act by interfering with the insect molting process. Chitin synthesis inhibitors include, but are not limited to, chlorofluazuron, cyromazine, diflubenzuron, fluazuron, flucycloxuron, flufenoxuron, hexaflumoron, lufenuron, tebufenozide, teflubenzuron, triflumoron, novaluron, 1-(2,6-difluorobenzoyl)-3-(2-fluoro-4-(trifluoromethyl)phenylurea, 1-(2,6-difluoro-benzoyl)-3-(2-fluoro-4-(1,1,2,2-tetrafluoroethoxy)-phenylurea and 1-(2,6-difluorobenzoyl)-3-(2-fluoro-4-trifluoromethyl)phenylurea.

In yet another embodiment, an active agent within the container 105 may include one or more pyrethrin or pyrethroid adulticide insecticide and/or acaricide. These include the pyrethrins cinerin I, cinerin II, jasmolin I, jasmolin II, pyrethrin I, pyrethrin II and mixtures thereof, and the pyrethroids permethrin, cyhalothrin, cypermethrin, cyphenothrin, deltamethrin, dimefluthrin, esfenvalerate, etofenprox, fenvalerate, fenpropathrin, flucythrinate, flumethrin, imiprothrin, lambda-cyhalothrin, metofluthrin, phenothrin, prallethrin, resmethrin, silafluofen, tau-fluvalinate, tefluthrin, tetramethrin, tralomethrin and transfluthrin. Suitable carbamates include, but are not limited to, benomyl, carbanolate, carbaryl, carbofuran, meththiocarb, metolcarb, promacyl, propoxur, aldicarb, butocarboxim, oxamyl, thiocarboxime and thiofanox.

In some embodiments, the active agent included in the container 105 may be one or more antinematodal agents including, but not limited to, active agents in the benzimidazoles, imidazothiazoles, tetrahydropyrimidines, and organophosphate class of compounds. In some embodiments, benzimidazoles include, but are not limited to, thiabendazole, cambendazole, parbendazole, oxibendazole, mebendazole, flubendazole, fenbendazole, oxfendazole, albendazole, cyclobendazole, febantel, thiophanate and its o,o-dimethyl analogue.

In other embodiments, the active agent within the container 105 may be an imidazothiazole compound including, but not limited to, tetramisole, levamisole and butamisole.

In still other embodiments, the active agent within the container 105 may be a tetrahydropyrimidine active agent including, but not limited to, pyrantel, oxantel, and morantel.

Suitable organophosphate active agents that may be transported by the container 105 include, but are not limited to, coumaphos, trichlorfon, haloxon, naftalofos and dichlorvos, heptenophos, mevinphos, monocrotophos, TEPP, and tetrachlorvinphos.

In other embodiments, the active agent within the container 105 may be an antinematodal compound such as phenothiazine and piperazine as the neutral compounds, or in various salt forms; diethylcarbamazine, phenols such as disophenol, arsenicals such as arsenamide, ethanolamines such as bephenium, thenium closylate, and methyridine; cyanine dyes including pyrvinium chloride, pyrvinium pamoate and dithiazanine iodide; isothiocyanates including bitoscanate, suramin sodium, phthalofyne, and various natural products including, but not limited to, hygromycin B, α-santonin and kainic acid.

In other embodiments, the container 105 may include an antitrematodal agent. Suitable antitrematodal agents include, but are not limited to, the miracils such as miracil D and mirasan; praziquantel, clonazepam and its 3-methyl derivative, oltipraz, lucanthone, hycanthone, oxamniquine, amoscanate, niridazole, nitroxynil, various bisphenol compounds known in the art including hexachlorophene, bithionol, bithionol sulfoxide and menichlopholan; various salicylanilide compounds including tribromsalan, oxyclozanide, clioxanide, rafoxanide, brotianide, bromoxanide and closantel; triclabendazole, diamfenetide, clorsulon, hetolin and emetine.

Anticestodal compounds may also be included in the container 105 including, but not limited to, arecoline in various salt forms, bunamidine, niclosamide, nitroscanate, paromomycin and paromomycin II.

In yet other embodiments, the container 105 may include active agents that are effective against arthropod parasites. Suitable active agents include, but are not limited to, bromocyclen, chlordane, DDT, endosulfan, lindane, methoxychlor, toxaphene, bromophos, bromophos-ethyl, carbophenothion, chlorfenvinphos, chlorpyrifos, crotoxyphos, cythioate, diazinon, dichlorenthion, diemthoate, dioxathion, ethion, famphur, fenitrothion, fenthion, fospirate, iodofenphos, malathion, naled, phosalone, phosmet, phoxim, propetamphos, ronnel, stirofos, allethrin, cyhalothrin, cypermethrin, deltamethrin, fenvalerate, flucythrinate, permethrin, phenothrin, pyrethrins, resmethrin, benzyl benzoate, carbon disulfide, crotamiton, diflubenzuron, diphenylamine, disulfiram, isobornyl thiocyanato acetate, methoprene, monosulfiram, pirenonylbutoxide, rotenone, triphenyltin acetate, triphenyltin hydroxide, deet, dimethyl phthalate, and the compounds 1,5a,6,9,9a,9b-hexahydro-4a (4H)-dibenzofurancarboxaldehyde (MGK-11), 2-(2-ethylhexyl)-3a,4,7,7a-tetrahydro-4,7-methano-1H-isoindole-1,3 (2H)dione (MGK-264), dipropyl-2,5-pyridinedicarboxylate (MGK-326) and 2-(octylthio) ethanol (MGK-874).

Another antiparasitic agent that may be included in the container 105 includes a biologically active peptide or protein including, but not limited to, cyclic depsipeptides, which act at the neuromuscular junction by stimulating presynaptic receptors belonging to the secretin receptor family resulting in the paralysis and death of parasites. In one embodiment, the cyclic depsipeptide is an octacyclodepsipeptide such as emodepside or PF1022A (see Willson et al., *Parasitology*, January 2003, 126 (Pt 1): 79-86). In another embodiment, the cyclooctadepsipeptides is an active agent described in U.S. Pat. Nos. 10,081,656 and 10,344,056 (both incorporated herein by reference).

In another embodiment, an active agent from the neonicotinoid class of pesticides may be included in the container 105. The neonicotinoids bind and inhibit insect specific nicotinic acetylcholine receptors. In one embodiment, the neonicotinoid insecticidal agent is imidacloprid. Imidacloprid is a well-known neonicotinoid active agent and is the key active ingredient in the topical parasiticide products Advantage®, Advantage® II, K9 Advantix®, and K9 Advantix® II sold by Elanco Animal Health. Agents of this class are described, for example, in U.S. Pat. No. 4,742,060 or in EP 0 892 060 (incorporated herein by reference).

In another embodiment, the neonicotinoid active agent transported by the container 105 is nitenpyram. Nitenpyram is the active ingredient in the oral product CAPSTAR™ Tablets sold by Novartis Animal Health. Nitenpyram is active against adult fleas when given daily as an oral tablet. Nitenpyram works by interfering with normal nerve transmission and leads to the death of the insect. Nitenpyram has a very fast onset of action against fleas. For example, CAPSTAR™ Tablets begin to act against fleas in as early as 30 minutes after administration and is indicated for use as often as once a day.

In another embodiment, an insecticidal agent that can be included in the container 105 of the invention is a semicarbazone, such as metaflumizone.

In another embodiment, an isoxazoline compound known in the art may be included in the container 105. These isoxazoline active agents are described in U.S. Pat. Nos. 7,964,204, 8,410,153, US 2011/0152312, US 2010/0254960 A1, US2011/0159107, US2012/0309620, US2012/0030841, US2010/0069247, WO 2007/125984, WO 2012/086462, U.S. Pat. No. 8,318,757, US 2011/0144349, U.S. Pat. No. 8,053,452; US 2010/0137612, US 2010/0254959, US 2011/152081, WO 2012/089623, WO 2012/089622, U.S. Pat. Nos. 8,119,671; 7,947,715; WO 2102/120135, WO 2012/107533, WO 2011/157748, US 2011/0245274, US 2011/0245239, US 2012/0232026, US 2012/0077765, US 2012/

0035122, US 2011/0251247, WO 2011/154433, WO 2011/154434, US 2012/0238517, US 2011/0166193, WO 2011/104088, WO 2011/104087, WO 2011/104089, US 2012/015946, US 2009/0143410, WO 2007/123855 A2, US 2011/0118212, U.S. Pat. No. 7,951,828 & U.S. Pat. No. 7,662,972, US 2010/0137372 A1, US 2010/0179194 A2, US 2011/0086886 A2, US 2011/0059988 A1, US 2010/0179195 A1, U.S. Pat. Nos. 7,897,630, 7,951,828 and 7,662,972, all of which are incorporated herein by reference in their entirety.

Isoxazoline compounds that may be transported by the container 105 include, but are not limited to, afoxolaner, esafoxolaner, umifoxolaner, fluralaner, sarolaner and lotilaner.

In another embodiment of the invention, nodulisporic acid and its derivatives (a class of known acaricidal, anthelmintic, anti-parasitic and insecticidal agents) may be included in the container 105. These compounds are used to treat or prevent infections in humans and animals and are described, for example, in U.S. Pat. Nos. 5,399,582, 5,962,499, 6,221,894 and 6,399,786, all of which are hereby incorporated by reference in their entirety.

In another embodiment, anthelmintic compounds of the amino acetonitrile class (AAD) of compounds such as monepantel (ZOLVIX), and the like, may be included in the container 105. These compounds are described, for example, in WO 2004/024704 and U.S. Pat. No. 7,084,280 (incorporated by reference); Sager et al., Veterinary Parasitology, 2009, 159, 49-54; Kaminsky et al., Nature vol. 452, 13 Mar. 2008, 176-181.

The container 105 of the invention may also include aryloazol-2-yl cyanoethylamino compounds such as those described in U.S. Pat. No. 8,088,801 to Soll et al., which is incorporated herein by reference, and thioamide derivatives of these compounds, as described in U.S. Pat. No. 7,964,621, also incorporated herein by reference.

Paraherquamide compounds and derivatives of these compounds, including derquantel (see Ostlind et al., *Research in Veterinary Science,* 1990, 48, 260-61; and Ostlind et al., *Medical and Veterinary Entomology,* 1997, 11, 407-408) may also be included in the container 105. The paraherquamide family of compounds is a known class of compounds that include a spirodioxepino indole core with activity against certain parasites (see *Tet. Lett.* 1981, 22, 135; *J. Antibiotics* 1990, 43, 1380, and *J. Antibiotics* 1991, 44, 492). In addition, the structurally related marcfortine family of compounds, such as marcfortines A-C, are also known and may be combined with the formulations of the invention (see *J. Chem. Soc.—Chem. Comm.* 1980, 601 and *Tet. Lett.* 1981, 22, 1977). Further references to the paraherquamide derivatives can be found, for example, in WO 91/09961, WO 92/22555, WO 97/03988, WO 01/076370, WO 09/004432, U.S. Pat. Nos. 5,703,078 and 5,750,695, all of which are hereby incorporated by reference in their entirety.

In a particular embodiment, the container 105 may have a combination of the phenylpyrazole fipronil and(S)-methoprene. This combination of active agents is present in the companion animal treatment product Frontline® Plus, sold as of this writing.

In another embodiment, the container 105 may have a combination of fipronil, (S)-methoprene and pyriproxyfen. This combination of active agents is present in the companion animal treatment product Frontline® Gold for dogs, sold as of this writing.

In another embodiment, the container 105 may have a combination of the phenylpyrazole active agent fipronil, permethrin and pyriproxyfen. This combination of active agents is present in the companion animal treatment product Frontline® Shield for dogs, sold as of this writing.

In another embodiment, the container 105 may have a combination of the phenylpyrazole fipronil and permethrin. This combination of active agents is present in the companion animal treatment products Frontline Tri-Act®/Frontect® sold as of this writing.

The container 105 is removable from the aperture 107 in the third section 106. The container 105 is releasably fastened to the front side 104*a* of the second section 104 by using peelable gel glue or other equivalent fastening method as understood by one of ordinary skill in the art.

In the perspective view of FIG. 1, a front side 102*a* of the front section 102 is visible, while a rear side 106*b* of the third section 106 is fully visible. Only a small portion of the front side 104*a* of the second section 104 is visible because the third section 106 is folded on top of the front side 104*a* of the second section 104. Further, the front side 102*a* of the first section 102 is "open" or has been lifted upwards relative to the rear section 106*b* of the third section 106. The second section 104 and third section 106 as shown in FIG. 1 may be described as being in a "closed" or "folded" state relative to each other, while the first section 102 relative to the third section 106 may be characterized as being in an "open" or "unfolded" state.

Each section 102, 104, 106 may further comprise writings comprising alpha-numeric human-readable text as well as machine-readable elements (i.e. 2-D Bar-Codes). The human-readable text/characters and/or machine-readable elements may further describe the contents of the container 105 and/or how the contents of the container 105 may be used by the consumer.

Referring now to FIG. 2, this figure illustrates the mailer system 101 in fully opened or unfolded state where the three sections 102, 104, 106 are substantially parallel to one another and where front sides 102*a*, 104*a*, and 106*a* of the three sections 102, 104, 106 are visible. In this view, the container 105 (see FIG. 1) has been removed from the system 101, while the aperture 107 remains visible. As noted previously, the aperture 107 has a shape which substantially mirrors the shape of the container 105. The aperture 107 is slightly larger than the container 105 so that it may enclose the container 105 and hold the container 107 when the mailer system 101 is in a folded or closed state.

In FIG. 2, compared to FIG. 1, additional sections 202 are visible. In FIG. 1, these sections 202 were removed and not present. The sections 202*a-g* may be removed or torn along the dashed lines presented in FIG. 2 and which are present along the three sections 102, 104, and 106. The sections 202*a-g* are generally present when the mailer system 101 is in a folded or closed state. Usually, an adhesive, such as, but not limited to glue (not visible in FIG. 2) may be applied to the sections 202 just prior to putting the mailer system 101 into a folded state.

The sections 202 containing the adhesive are generally removed from the mailer system 101 after the mailer system 101 has been transported or shipped to the consumer. As noted above, the sections 202 containing the adhesive may be removed along the cut or dashed lines shown in FIG. 2. In the view of FIG. 2, the front sides 102*a*, 104*a*, 106*a* of first, second and the third sections 102, 104, 106 are visible. Front side 102*a* may have text and/or graphics 133. In this exemplary embodiment, the graphic 133 depicts a companion animal (i.e. a dog).

The curved edge 127 of FIG. 2 is the curved edge 127 shown in FIG. 1 described above. As illustrated in FIG. 1, front side 106*a* of the third section 106 is folded onto and covers the front side 104*a* of the second section 104. The curved edge 127 is proximate to the front side 102*a* of the first section 102 because the front side 106*a* of the third section 106 is folded onto the second section 104.

Figure 3:
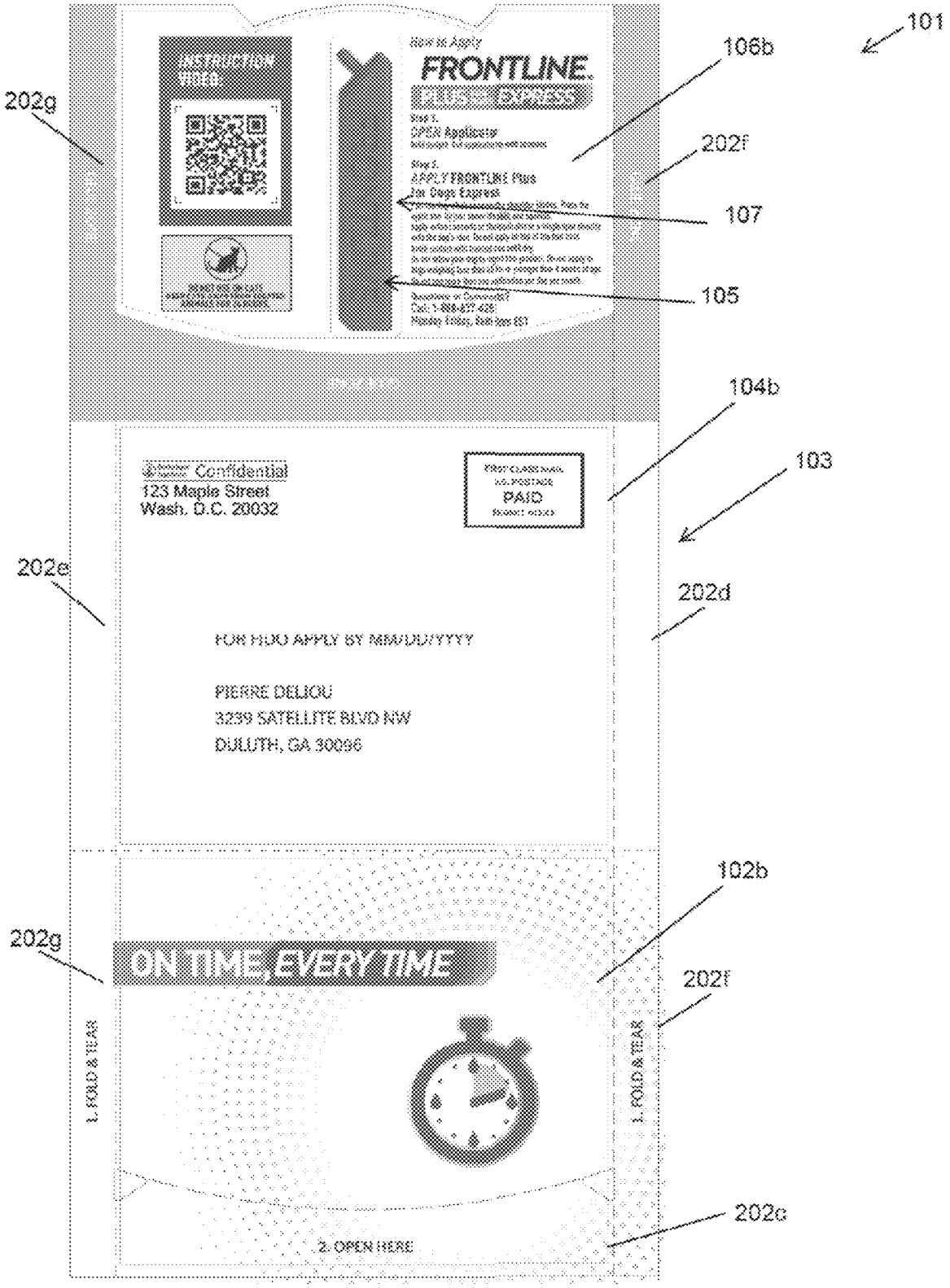
FIG. 3 illustrates the mailer system in fully opened or unfolded state where the three sections are substantially parallel to one another and where the rear sides of the sections are visible.

Referring now to FIG. 3, this figure illustrates the mailer system 101 in fully opened or unfolded state where the three sections 102, 104, 106 are substantially parallel to one another and where rear sides 102*b*, 104*b*, and 106*c* of the three sections 102, 103, and 106 are visible. FIG. 3 is similar to FIG. 2, therefore, only the differences between these two figures will be described here. In this FIG. 3, the container 105 is shown present and existing within the aperture 107. Usually, the container 105 is attached to the front side 104*a* of the second section 104 as shown in FIG. 1.

Each rear side 102*b*, 104*b*, and 106*b* of each section 102, 104, 106 may have unique and different human-readable alpha-numeric text as well as machine-readable elements, similar to the front sides 102*a*, 104*a*, 106*a*. The elements may include a postal address and a stamp or us postal permit either directly printed on the mailer, or printed on a paper label affixed to the mailer with the use of adhesives. The text and/or machine-readable elements of rear sides 102*b*, 104*b*, 106*b* may be different, similar, and/or identical to that information presented on the opposite sides 102*a*, 104*a*, 106*a*.

Figure 4:
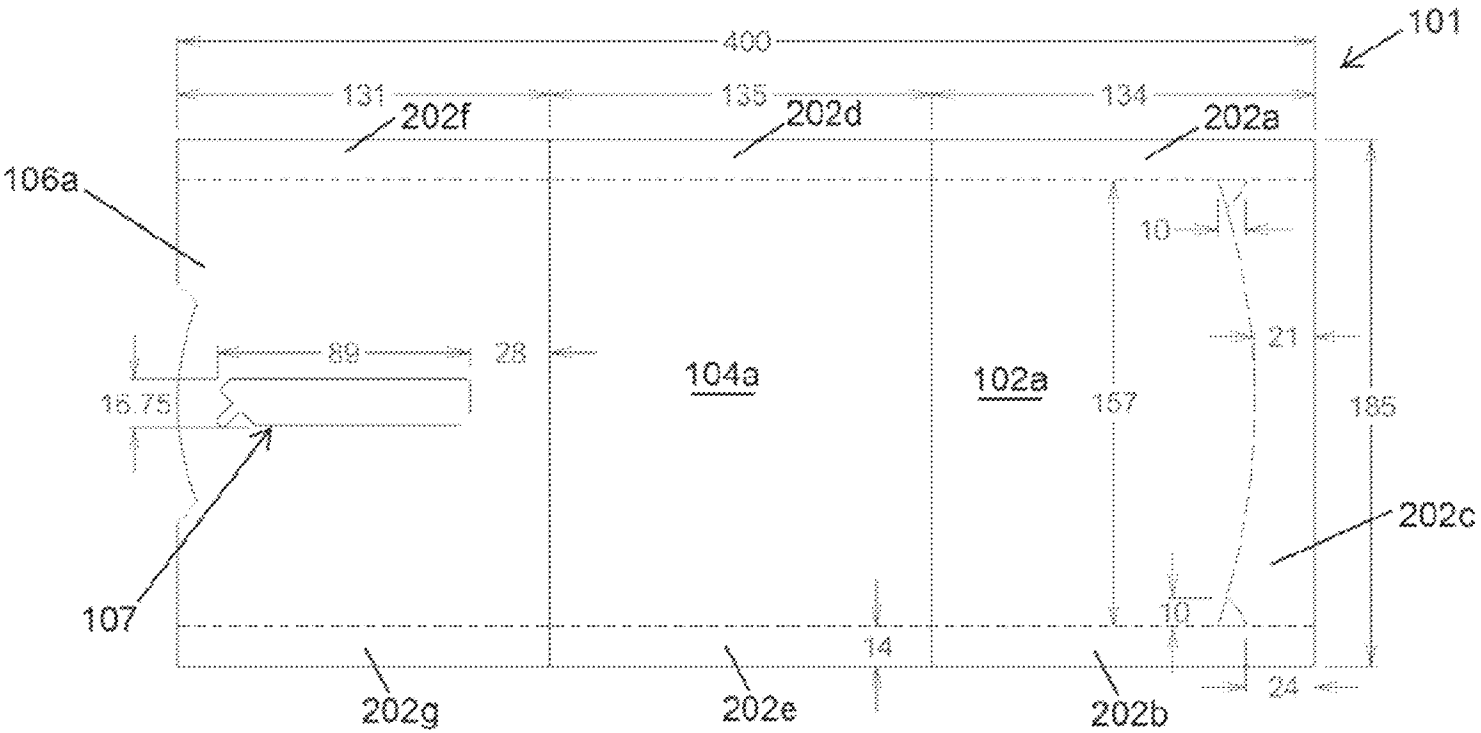
FIG. 4, this figure illustrates an elevational view of the mailer system with the three sections in a fully open or open state along with exemplary dimensions/sizes.

Referring now to FIG. 4, this figure illustrates an elevational view of the mailer system 101 with the three sections 102, 104, 106 in a fully open or open state along with exemplary dimensions/sizes. The exemplary dimensions illustrated in FIG. 4 are expressed in millimeters. However, other sizes and/or geometries are possible and are included within the scope of this disclosure. Other sizes may be smaller or larger than those shown in FIG. 4 as understood by one of ordinary skill in the art.

As noted previously, the sizes and/or geometry of the mailer system 101 should adhere to the "machinable" requirements set by the USPS for First-Class mail rates. While the mailer system 101 meets the USPS requirements/standards for first-class machinable mail, the mailer system 101 may also meet the requirements/standards for machinable mail in other jurisdictions outside of the United States, such as, but not limited to, the United Kingdom, Germany, France, Spain, Italy, Netherlands, Belgium, Australia, Japan, China, Taiwan, the Russian Federation, etc, etc.

Figures 5A, 5B:
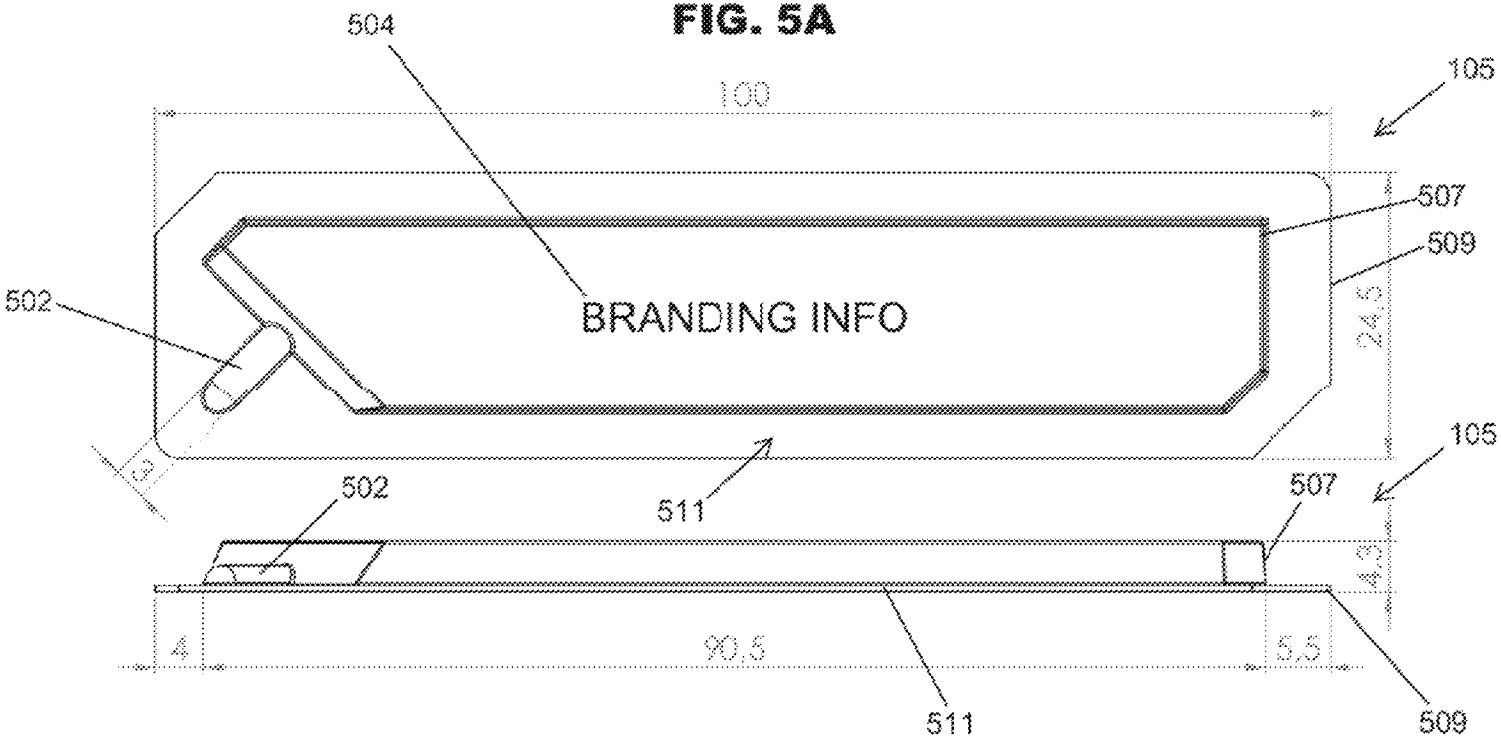
FIG. 5A illustrates a top view of the container according to one exemplary embodiment of the mailer system.
FIG. 5B is a side view of the container 105 illustrated in FIG. 5A according to one exemplary embodiment.

Referring now to FIG. 5A, this figure illustrates a top view of the container 105 according to one exemplary embodiment of the mailer system 101. Exemplary dimensions expressed in millimeters (mm) are also shown in FIG. 5A (see mm dimensions between several arrows in figure). Similar to FIG. 4, other sizes and/or geometries are possible and are included within the scope of this disclosure. Other sizes may be smaller or larger than those shown in FIG. 5A as understood by one of ordinary skill in the art. As noted previously, the sizes and/or geometry of the mailer system 101 should adhere to the "machinable" requirements set by the USPS for First-Class mail rates.

The container 105 may also comprise alpha-numeric text and/or machine readable elements 504. The text and/or elements 504 may comprise brand information such as a trademark or tradename. The container may further comprise an outlet 502 that may allow liquid (not visible) in the container 105 to exit, once an edge of the outlet 502 is cut and/or removed.

Figure 27A:
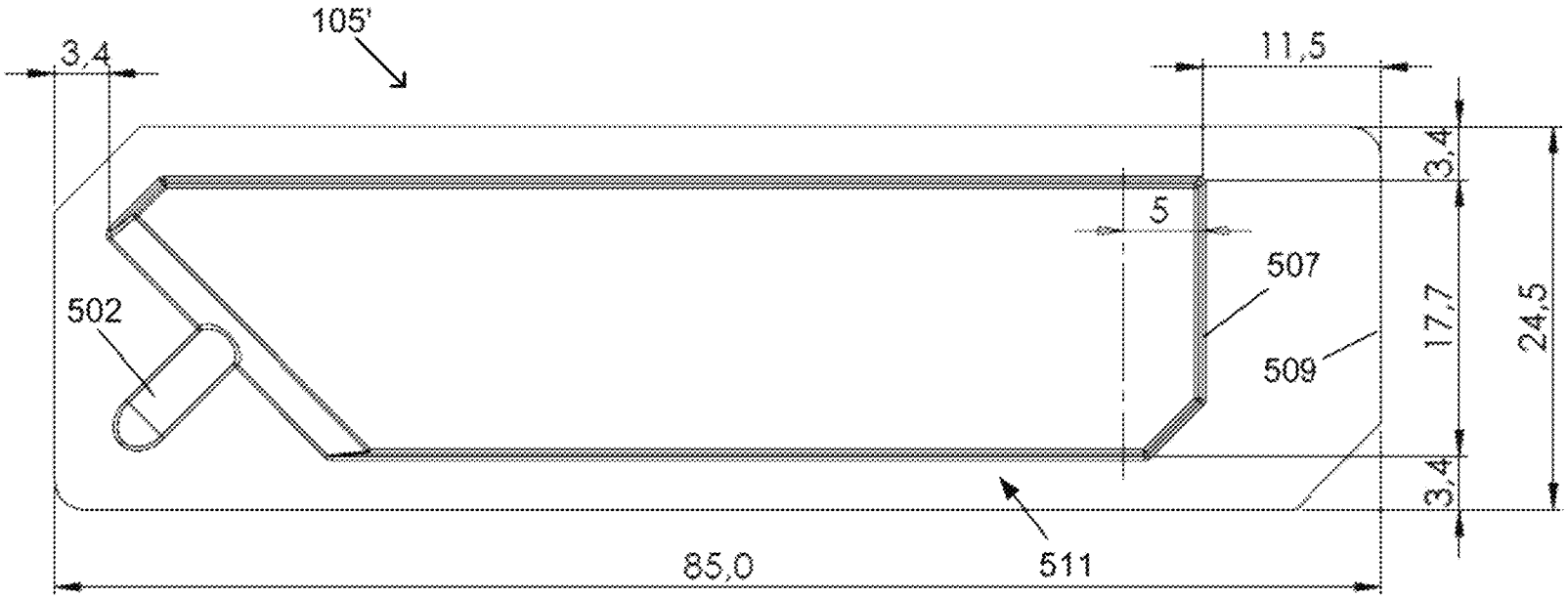
FIG. 27A illustrates a top view of the container according to an alternative exemplary embodiment of the mailer system.
Figure 27B:
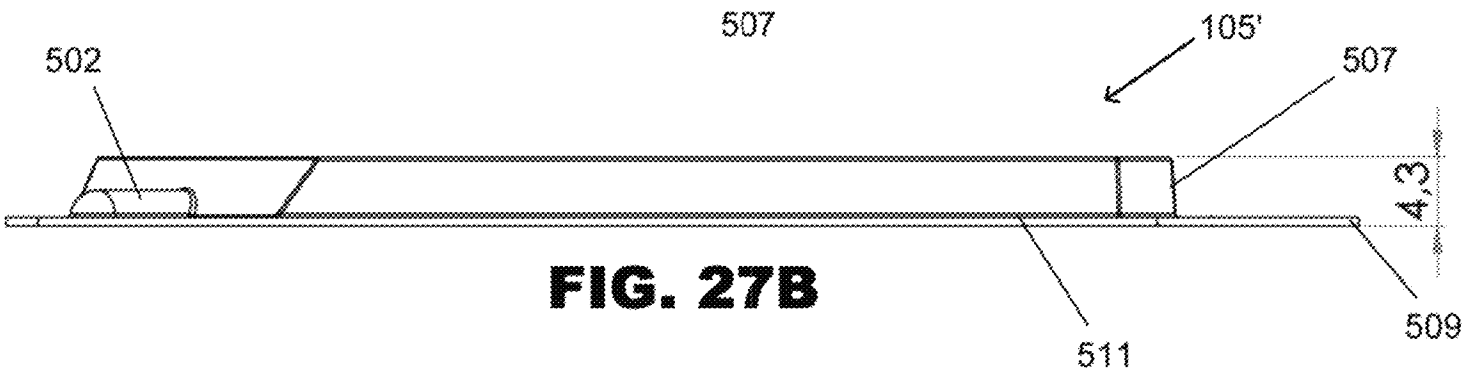
FIG. 27B is a side view of the container illustrated in FIG. 27A according to an alternative exemplary embodiment.

As illustrated in FIG. 5B, the container 105 has an end portion 507. The container 105 further has a bottom plate 511 where the end portion 507 is coupled to this bottom plate 511. The bottom plate 511 further has an edge 509. According to this exemplary embodiment of FIG. 5B, the distance between the end portion 507 and the edge 509 of the bottom plate 511 is approximately 5.5 mm. This dimension is noted since, as illustrated in FIGS. 27A-27B and will be described below, various dimensions for the container 105 may be adjusted as desired.

Referring now to FIG. 5B, this figure is side view of the container 105 illustrated in FIG. 5A according to one exemplary embodiment. FIG. 5B also provides exemplary dimensions, which are not limited to those shown. As noted previously, a height of the container 105 must be less than one quarter (¼) of an inch in order to meet the machinable First-Class mail requirements set by the USPS. A cumulative thickness of the cardboard mailer 101 and container 105 usually must be less than one-quarter (¼) of an inch in order to meet the machinable U.S. First-Class mail requirements set by the USPS.

As such, the height of the container 105 usually must be less than one-quarter (¼) inch to allow for the mailer cardboard thickness above and below the container 105. However, other sizes smaller or larger are possible and are within the scope of this disclosure. Other sizes which are greater may take the container 105 outside of the U.S. First-Class requirements, but this may be acceptable in certain circumstances when U.S. First-Class mailings are not desired and/or the container is being shipped/mailed outside of the U.S. where the First-Class requirements are not being followed by a non-U.S. jurisdiction. For example, these other jurisdictions may not be concerned with the U.S. First-Class requirements: the United Kingdom, Germany, France, Spain, Italy, Netherlands, Belgium, Australia, Japan, China, Taiwan, the Russian Federation, etc, etc.

Figures 6A, 6B:
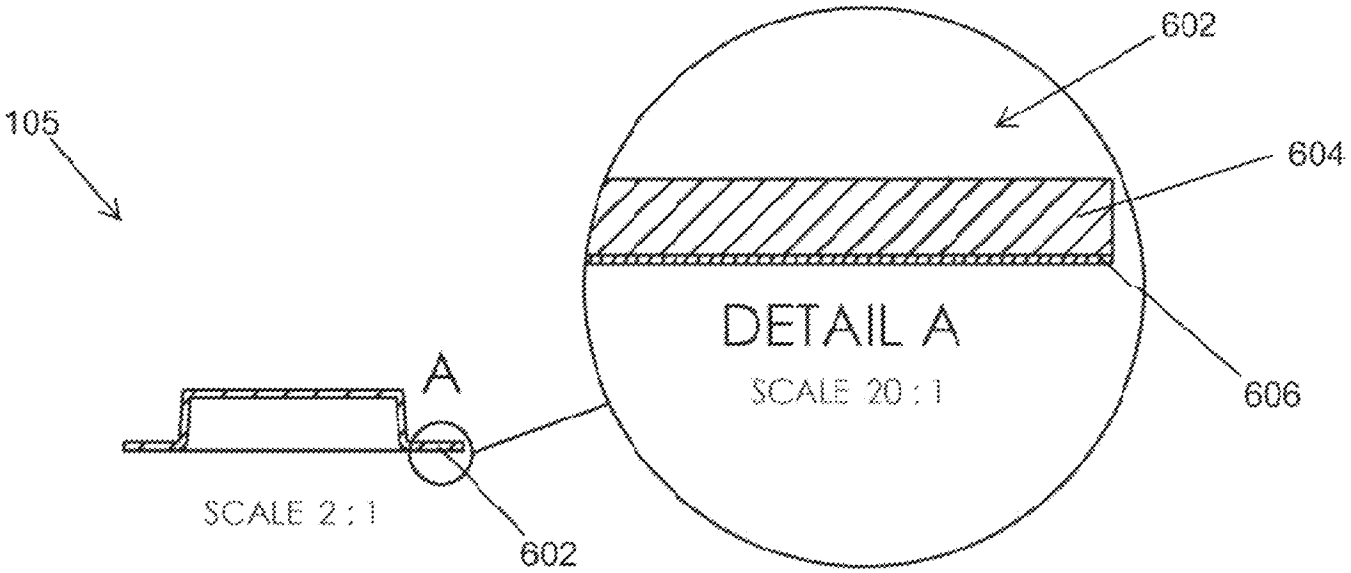
FIG. 6A illustrates a cross-sectional view of the container illustrated in FIGS. 5A-5B.
FIG. 6B illustrates a magnified view of a section depicted in FIG. 6A.

Referring now to FIG. 6A, this figure illustrates a cross-sectional view of the container 105 illustrated in FIGS. 5A-5B. An edge section 602 of the container 105 is visible in FIG. 6A. Referring now to FIG. 6B, this figure illustrates a magnified view of an edge section 602 depicted in FIG. 6A. The edge section 602 of the container 105 may have a top section 604 and a bottom section 606. The top section 604 of FIG. 6B may comprise a multi-layered structure.

And more specifically, top section 604 may comprise a plurality of layers, such as, but not limited to, the following layers in this exemplary order: (Exterior ambient air next to container 105)>Polypropylene-cyclo olefin copolymer-Polypropylene/Polyethylene-Ethylene vinyl alcohol-Polyethylene>(where the Polyethylene layer is the innermost layer which contacts the liquid within the container 105). An abbreviation for the multi-layer structure for top section 604 is as follows: PP-COC-PP/PE-EVOH-PE. However, other materials and combinations of materials are possible and included within the scope of this disclosure.

The bottom section 606, like the top section 604, may also comprise a multi-layered structure. And more specifically, bottom section 604 may comprise a plurality of layers, such as, but not limited to, the following layers in this exemplary order: (exterior ambient air outside of container 105) >Printed Ink>Polyethylene Terephthalate/Aluminum/Polyethylene-Ethylene vinyl alcohol-Polyethylene>(where the Polyethylene layer is the innermost layer which contacts the liquid within the container 105). An abbreviation for the multi-layer structure for bottom section 606 is as follows: PET/Alu/PE-EVOH-PE. However, other materials and combinations of materials are possible and included within the scope of this disclosure.

Figure 7:
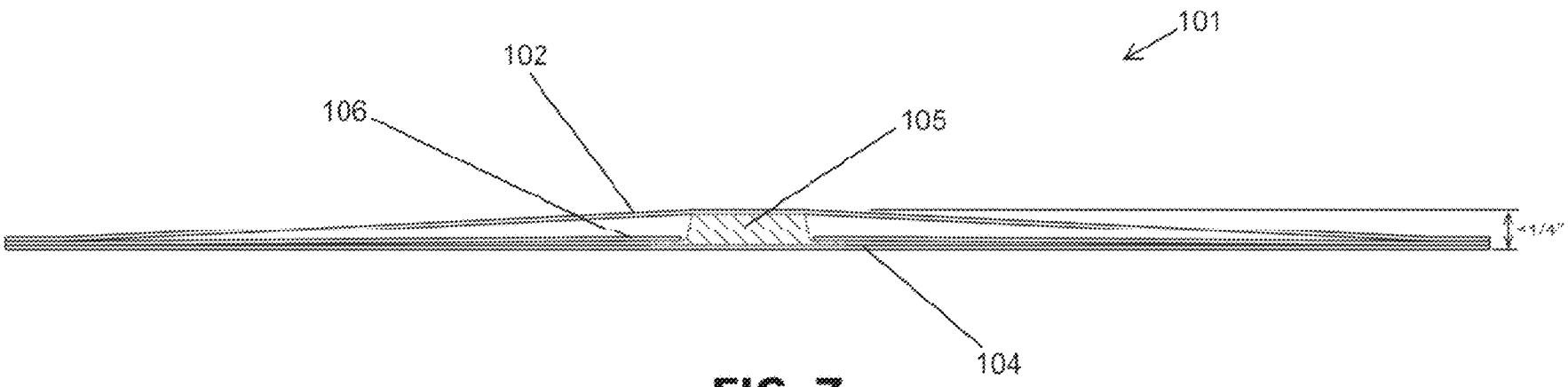
FIG. 7 illustrates a cross-sectional view of the mailer system when the mailer system is in a folded or closed state ready for transport or mailing.

Referring now to FIG. 7, this figure illustrates a cross-sectional view of the mailer system 101 when the mailer system 101 is in a folded or closed state ready for transport or mailing. Specifically, the three sections 102, 104, and 106 are folded on top of each other where the sections are stacked as follows: lowest or bottom position is the second, middle section 104; on top of the middle section 104 is the third section 106 (see FIGS. 2-3 for the sections in their unfolded state); and the first section is positioned on top of the third section 106. So the sequence is from the horizontal of FIG. 7 is section 104; section 106; and section 102. However, other sequences and/or stackings of the three sections 102, 104, 106 are possible and are included within the scope of this disclosure as understood by one of ordinary skill in the art.

Figure 8:
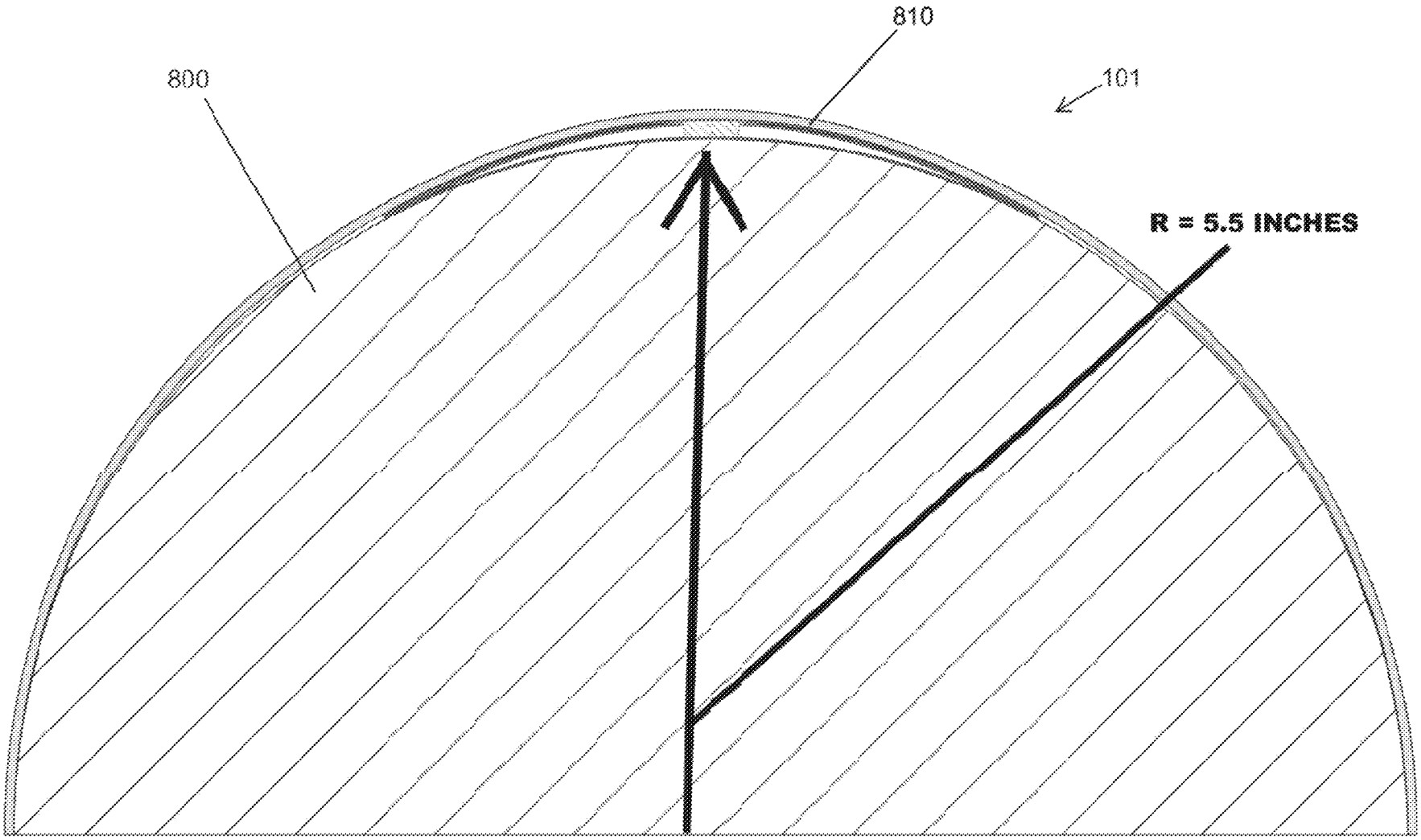
FIG. 8 illustrates a cross-sectional view of the mailer system when it is positioned around a drum of an automatic sorting system, and bent in shape by the tension of a transport belt.

Referring now to FIG. 8, this figure illustrates a cross-sectional view of the mailer system 101 when it is positioned around a drum 800 of an automatic mail sorting system. The mailer system 101 is bent in shape by the tension of a transport belt 810, as understood by one of ordinary skill in the art familiar with automated mail sorting systems.

Specifically, this figure shows how the mailer system 101 deflects around a drum 800 when the mailer system 101 flows through an automated mail sorting system. According to one exemplary embodiment, the drum 800 has a radius of approximately 5.5 inches, as set forth by the USPS.

As understood by one of ordinary skill in the art of automated mail sorting systems, to ensure transport through automated mail processing machines, a mail piece and its contents usually must bend easily when subjected to a transport belt tension of about 40.0 pounds around an 11.0 inch-diameter drum. This means, for U.S. mailings, the bend radius is generally 5.5 inches or greater. 5.5 inches is equal to about 140.0 mm. In Europe, each drum may be about 280.0 mm in diameter (i.e. Siemens brand sorting machines) or about 300.0 mm in diameter (i.e. Neopost sorting machines).

Other radii are possible and are included within the scope of this disclosure. Other radii may be larger or smaller than those depicted as understood by one of ordinary skill in the art.

Figure 9:
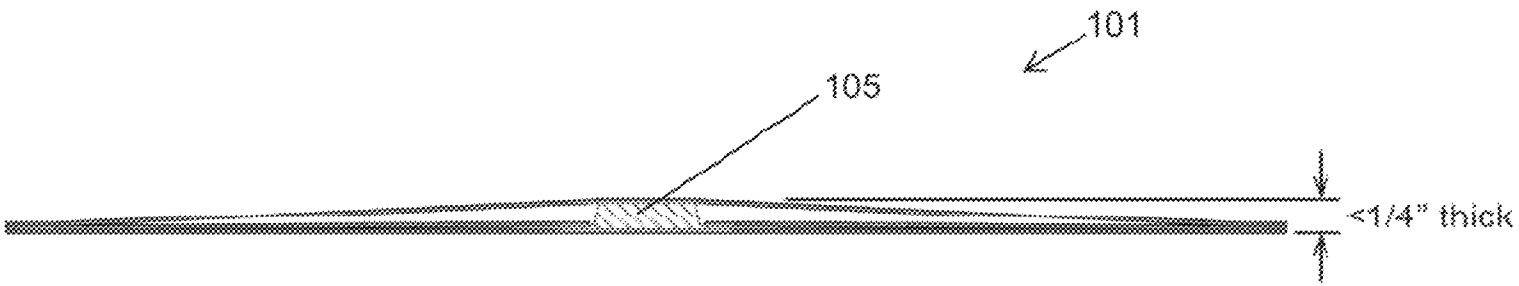
FIG. 9 illustrates a cross-sectional view of the mailer system when the mailer system is in a folded or closed state ready for transport or mailing similar to FIG. 7.

Referring now to FIG. 9, this figure illustrates a cross-sectional view of the mailer system 101 when the mailer system 101 is in a folded or closed state ready for transport or mailing similar to FIG. 7. In this FIG. 9, the container 105 is clearly shown in a geometric center of the mailer system 101 in its folded state. The maximum height of the mailer system 101 is also in the geometric center and in order to meet the USPS first-class mailing standards mentioned above, this height generally does not exceed 0.25 of an inch.

However, other sizes smaller or larger are possible and are within the scope of this disclosure. Other sizes which are greater may take the container 105 outside of the U.S. First-Class requirements, but this may be acceptable in certain circumstances when U.S. First-Class mailings are not desired and/or the container is being shipped/mailed outside of the U.S. where the First-Class requirements are not being followed by a non-U.S. jurisdiction.

Figure 10:
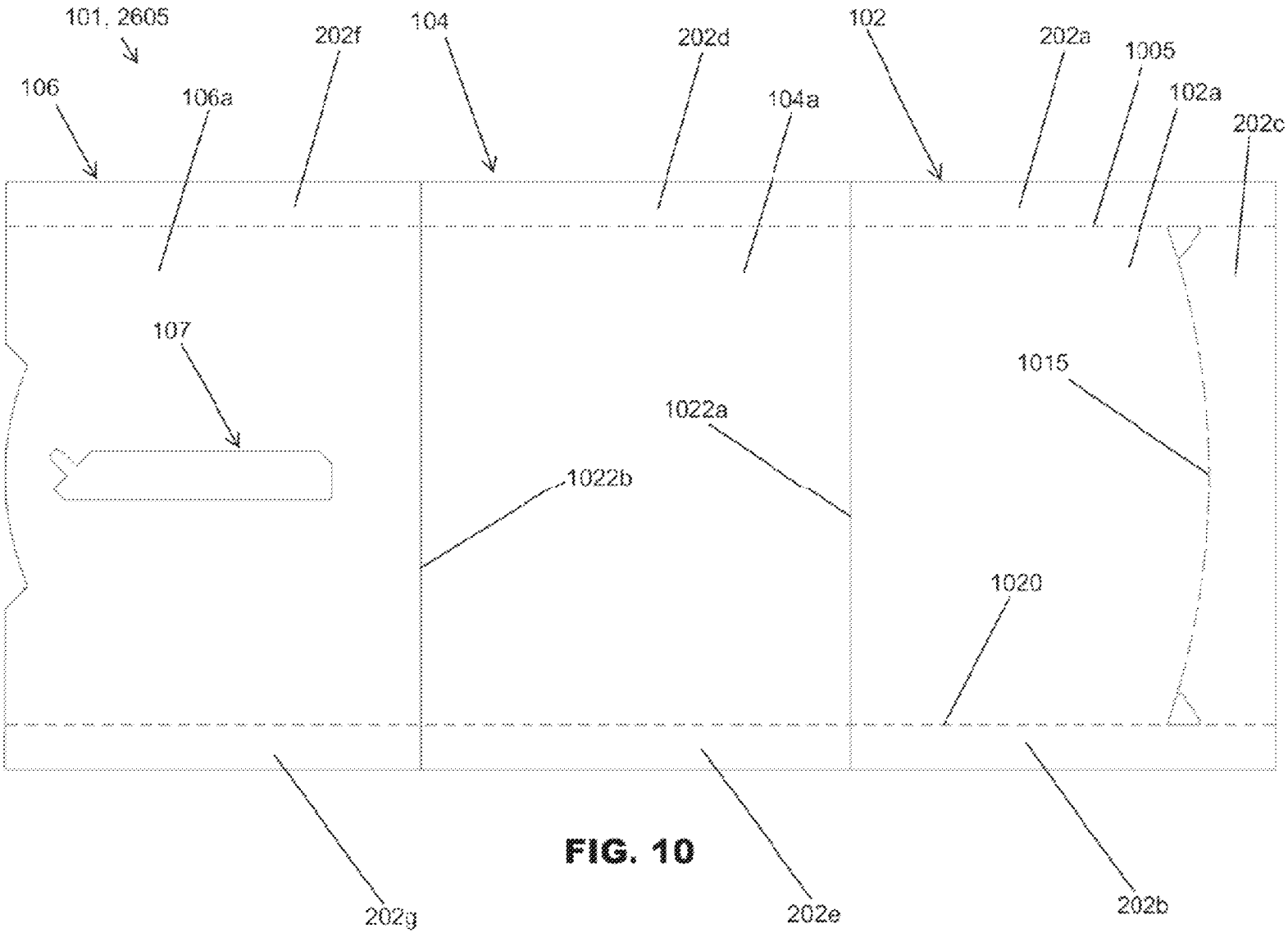
FIG. 10 is an elevational view of the mailer system and illustrates a first step 2605 (see flow chart of FIG. 26) in forming the mailer system.

Referring now to FIG. 10, this figure is an elevational view of the mailer system 101 and illustrates a first step 2605 (see flow chart of FIG. 26) in forming the mailer system 101. In this first step 2605, the mailer system is formed with at least three perforation or cut lines 1005, 1015, 1020. Sections 202*a*-202*g* may be removed later as described below along these cut lines 1005, 1015, 1020. In this first step 2605 shown in FIG. 10, aperture 107 is also formed. Further, two fold lines 1022*a*, 1022*b* may be formed and which create the three sections 102*a*, 104*a*, 106*a* of the tri-fold. As noted previously, aperture 107 generally has a shape which is substantially similar to the shape of the container 105 (see FIG. 5A). However, as noted previously, aperture 107 generally has a larger perimeter compared to the perimeter for the container 105.

Also, a cut line 1015 may have a curved shape. However, in other exemplary embodiments, the cut line 1015 may have another shape such as straight, or other shapes as needed as understood to one of ordinary skill in the art.

Figure 11:
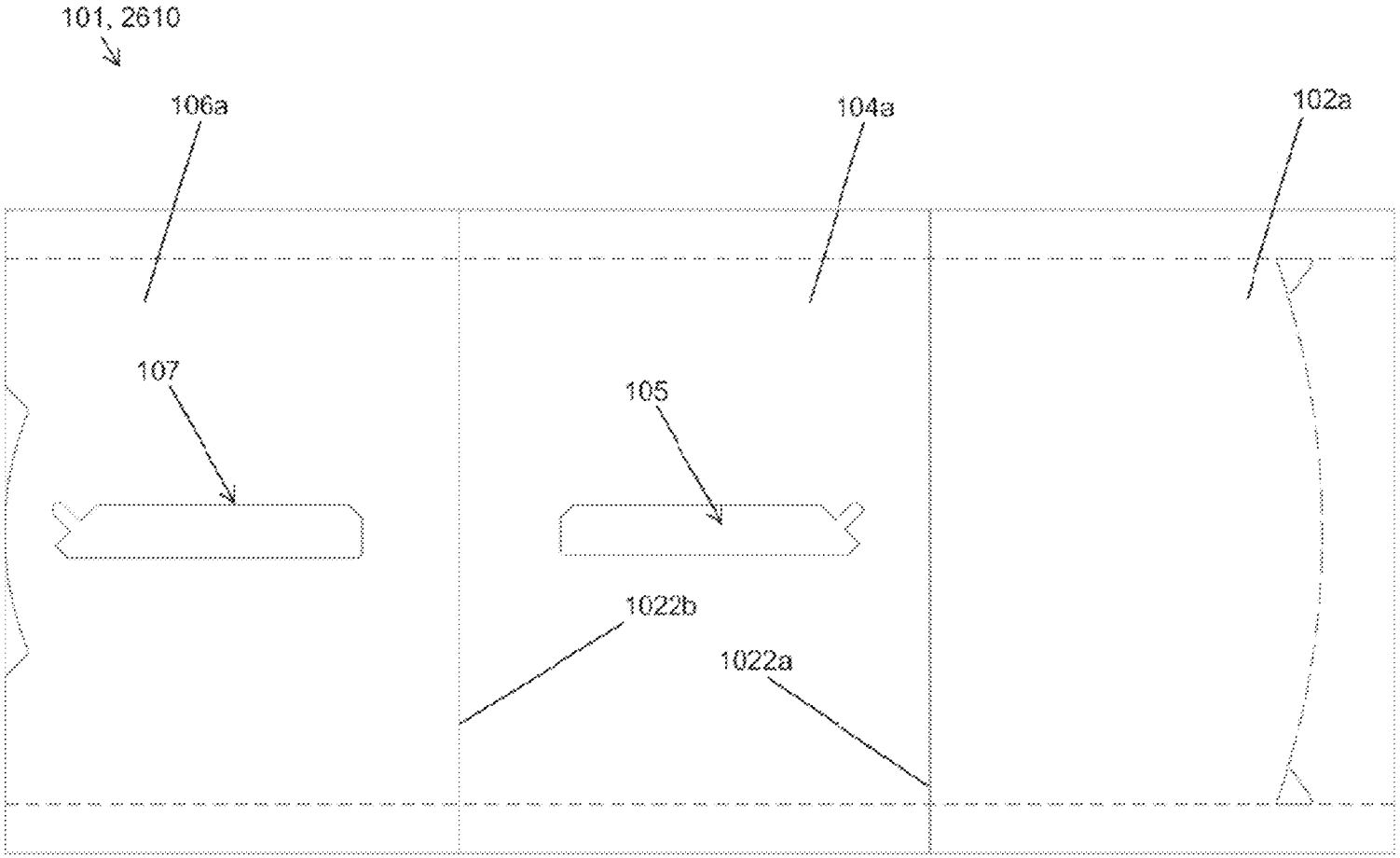
FIG. 11 is an elevational view of the mailer system and a second step 2610 (see flow chart of FIG. 26) in forming the mailer system.

Referring now to FIG. 11, this figure is an elevational view of the mailer system 101 and illustrates a second step 2610 (see flow chart of FIG. 26) in forming the mailer system 101. FIG. 11 is substantially similar to FIG. 10. So only the differences between FIG. 10 and FIG. 11 will be described here. In FIG. 11, the container 105 may be formed which has a shape that is substantially similar to the shape of the aperture 107. The container 105 is positioned in the second section 104*a* of the trifold such that when the third section 106*a* is folded over and on top of the second section 104*a*, the aperture 107 will align itself around the container 105. Thus, in FIG. 11, the container 105 is positioned at a mirror-image or reverse-side relative to the fold line 1022*b* and relative to the aperture 107. The container 105 is affixed to the mailer system 101 by use of adhesives, like peelable gel glue, or a functional equivalent, which may include a fastening device or mechanism (i.e. tape, staple, apertures/slits in supporting surface, etc.).

Figure 12:
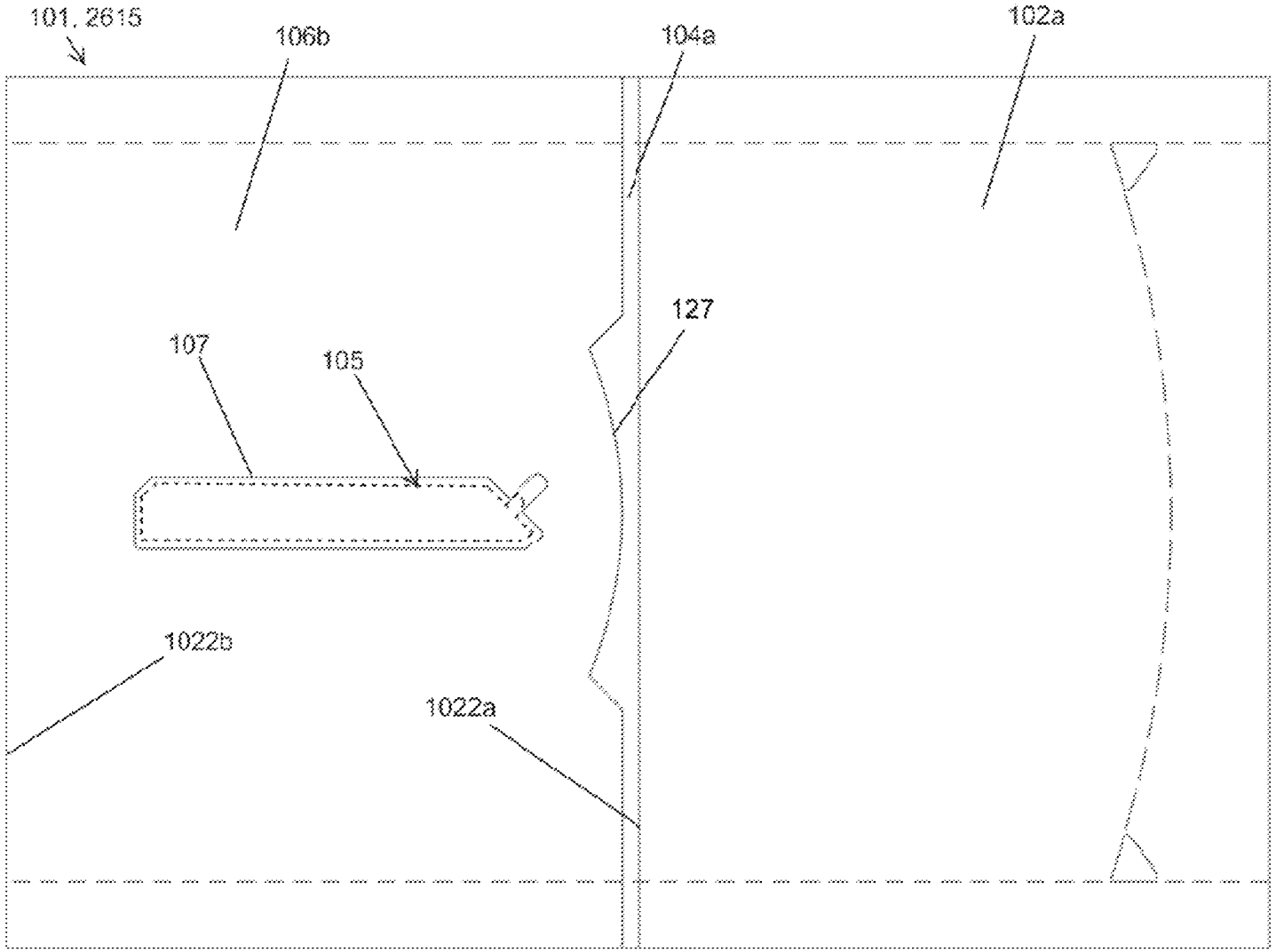
FIG. 12 illustrates how the third section of the tri-fold has been folded along a fold line so that its back side is now visible and is positioned on top of the second section.

Referring now to FIG. 12, this figure is an elevational view of the mailer system 101 and illustrates a third step 2615 (see flow chart of FIG. 26) in forming the mailer system 101. FIG. 12 is substantially similar to FIG. 11. So only the differences between FIG. 12 and FIG. 11 will be described here.

In FIG. 12, the third section 106*a* has been folded along fold line 1022*b* so that its back side 106*b* is now visible and is positioned on top of the second section 104*a*. The curved edge 127 of the third section 106*a* is now proximate to the front side 102*a* of the third section 102. The aperture 107 has now been positioned over the container 105. The container 105 has been illustrated with dashed lines 105 in this figure. The third section 102*a* has remained in its same position relative to FIG. 11.

Figure 13A:
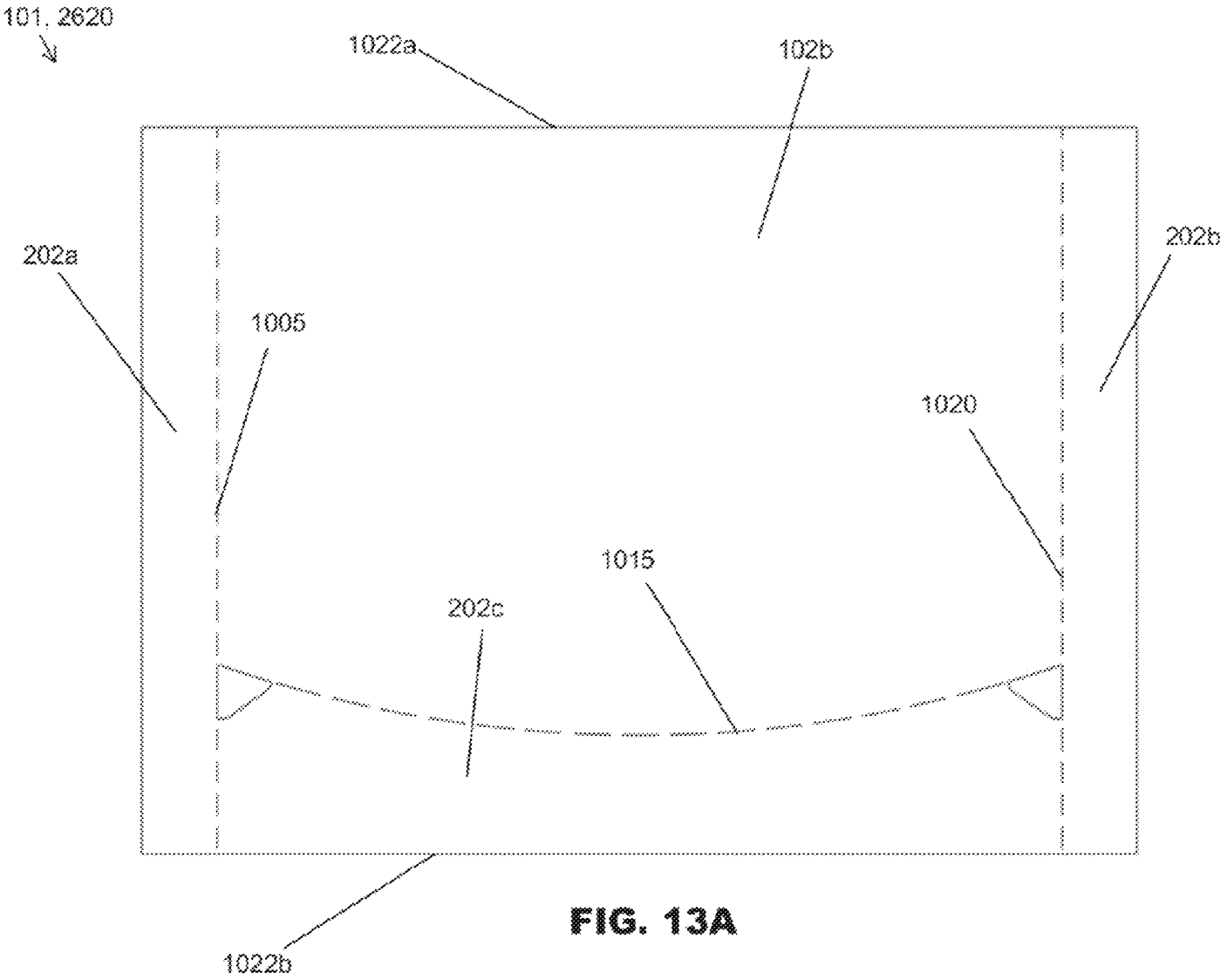
FIG. 13A is an elevational view of the mailer system and illustrates a fourth step 2620 (see flow chart of FIG. 26) in forming the mailer system.

Referring now to FIG. 13A, this figure is an elevational view of the mailer system 101 and illustrates a fourth step 2620 (see flow chart of FIG. 26) in forming the mailer system 101. FIG. 13A is substantially similar to FIG. 12. So only the differences between FIG. 13A and FIG. 12 will be described here.

In this figure, relative to the view of FIG. 12, the mailer system 101 has been rotated counter-clockwise by ninety degrees (90°). And the third section 102 has been folded along fold line 1022*a* such that its rear side 102*b* is now visible and folded over the container 105 (not visible in FIG. 13A). Meanwhile, front side 102*a* of third section 102 is visible in FIG. 12. The perforation lines 1005, 1015, and 1020 are also visible in this FIG. 13A.

Figure 13B:
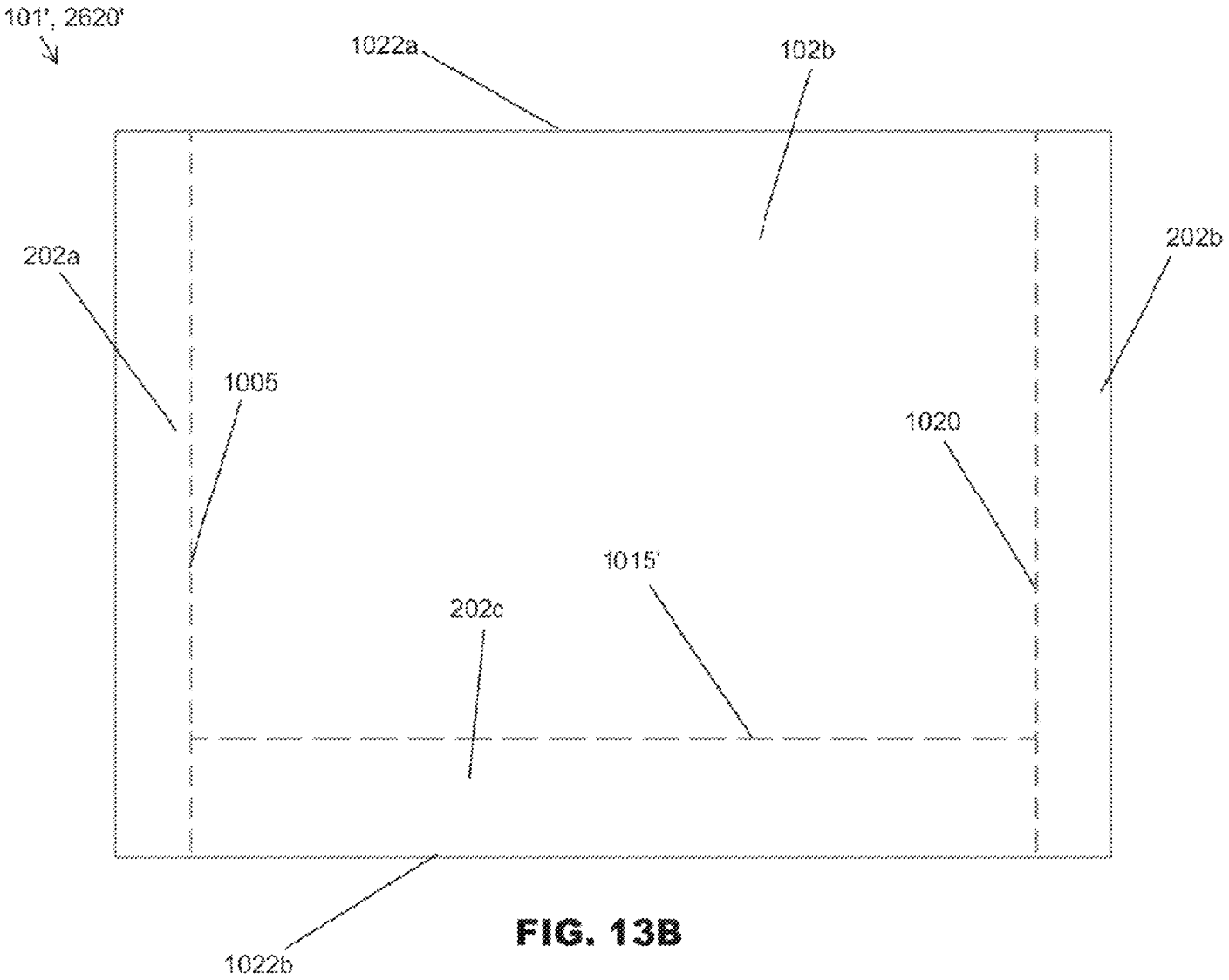
FIG. 13B is an elevational view of the mailer system and illustrates another version/embodiment for the fourth step 2620' (see flow chart of FIG. 26) in forming the mailer system.

Referring now to FIG. 13B, this figure is an elevational view of the mailer system 101 and illustrates another version/embodiment for the fourth step 2620' (see flow chart of FIG. 26) in forming the mailer system 101. FIG. 13B is substantially similar to FIG. 13A. So only the differences between FIG. 13A and FIG. 13B will be described here.

In this FIG. 13B, the cut line 1015' is straight compared to the cut line 1015 of FIG. 13A. In FIG. 13A, the cut-line 1015 is curved. Thus, as understood by one of ordinary skill in the art, each of the cut lines or perforation lines 1005, 1015, 1015', 1020 may have different shapes than those illustrated, and these different shapes are well within the scope of this disclosure.

The mailer systems 101, 101' of FIGS. 13A, 13B are closed and can receive first class postage markings/stamps/franking 1402, etc. (See FIG. 14) in a fifth step 2625 of a method 2600 (See FIG. 26). Further, the mailer system 101, 101' may receive alpha-numeric text and/or machine-readable codes that provide a mailing address 1404 (See FIG. 14). In this fifth step 2625, the mailer systems 101, 101' may be "machined" and can be processed by drums 800 illustrated in FIG. 8. Thus, in this fifth step 2625 of method 2600, the mailer systems 101, 101' are flexible or bendable around drums 800 illustrated in FIG. 8 during automated sorting used by the USPS, and other jurisdictions/entities.

Figure 14:
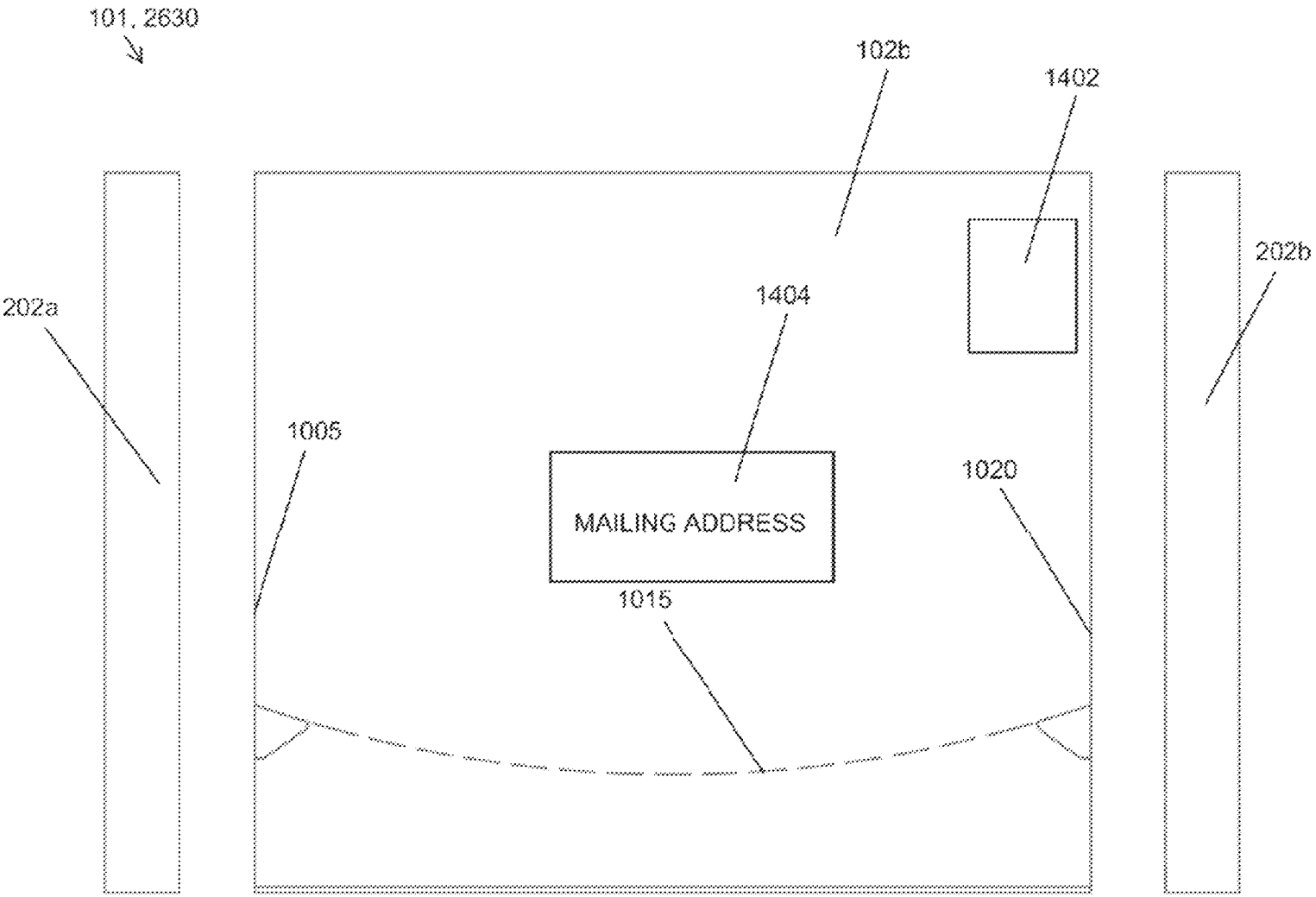
FIG. 14 is an elevational view of the mailer system and illustrates a sixth step 2630 (see flow chart of FIG. 26) in forming the mailer system.

Referring now to FIG. 14, this figure is an elevational view of the mailer system 101 and illustrates a sixth step 2630 (see flow chart of FIG. 26) in forming the mailer system 101. FIG. 14 is substantially similar to FIG. 13A. So only the differences between FIG. 13A and FIG. 14 will be described here.

In this FIG. 14 and step 2630, the mailer system 101 has been received by the consumer located at the mailing address 1404 and the consumer may now open the mailer system 101 by removing two sections 202*a*, 202*b* along perforation lines 1005, 1020.

Figure 15:
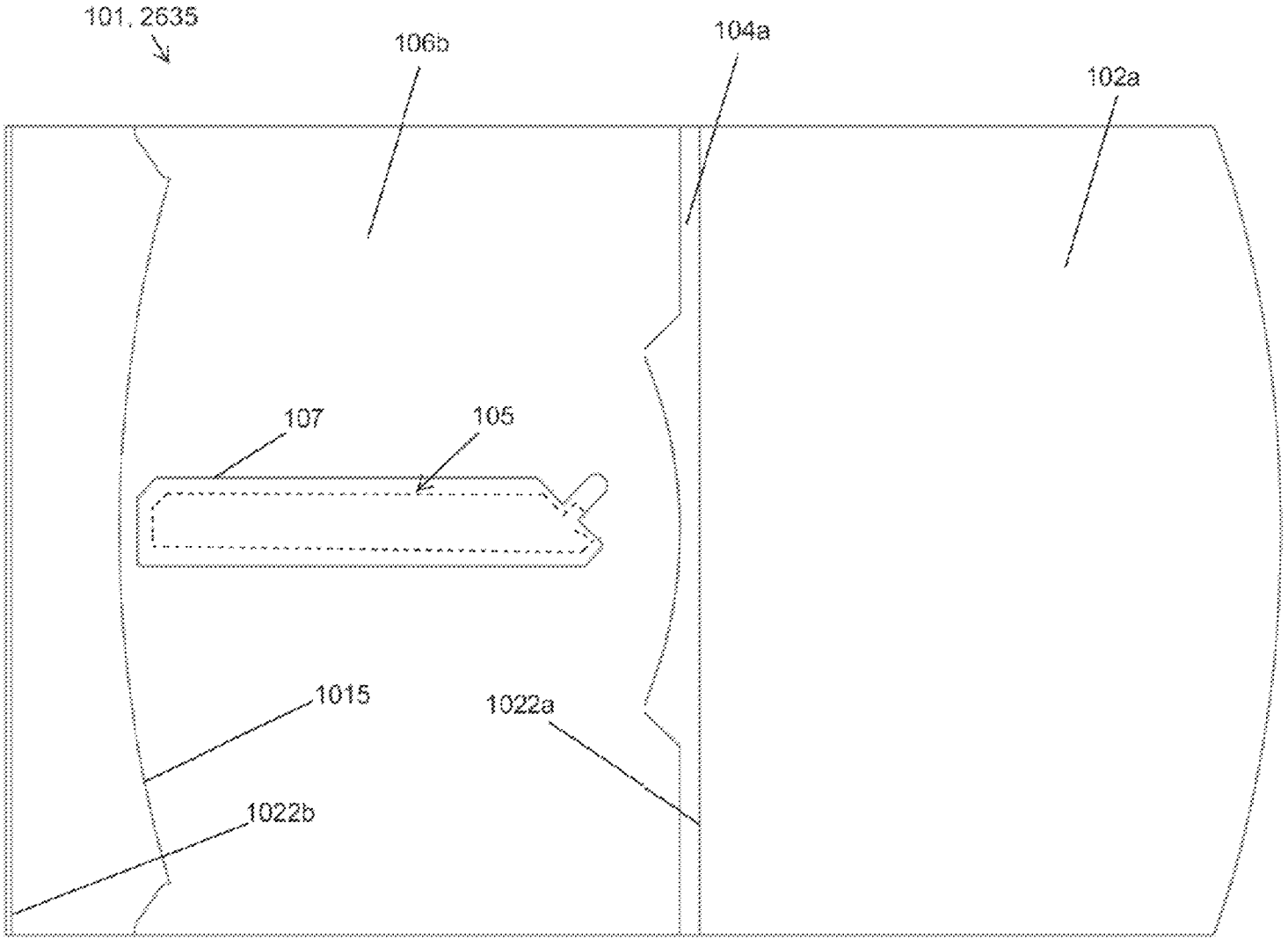
FIG. 15 is an elevational view of the mailer system and illustrates a seventh step 2635 (see flow chart of FIG. 26) in forming the mailer system.

Referring now to FIG. 15, this figure is an elevational view of the mailer system 101 and illustrates a seventh step 2635 (see flow chart of FIG. 26) in forming the mailer system 101. FIG. 15 is substantially similar to FIG. 14A. So only the differences between FIG. 15 and FIG. 14 will be described here.

Relative to FIG. 14, the mailer system 101 of FIG. 15 has been rotated clock-wise by about ninety degrees (90°). The third section 102*a* of the tri-fold has been "opened-up" by opening 102*a* along the curved cut-line 1015 and unfolding it along fold line 1022*a*. The inside third section 102*a* and inside second section 104*a* are now visible in FIG. 15. The outside first section 106*b* is also visible in FIG. 15. As noted previously, the container 105 is held on to the front surface 104*a* of section 104 by an adhesive such as a gel-glue as described previously.

Figure 16:
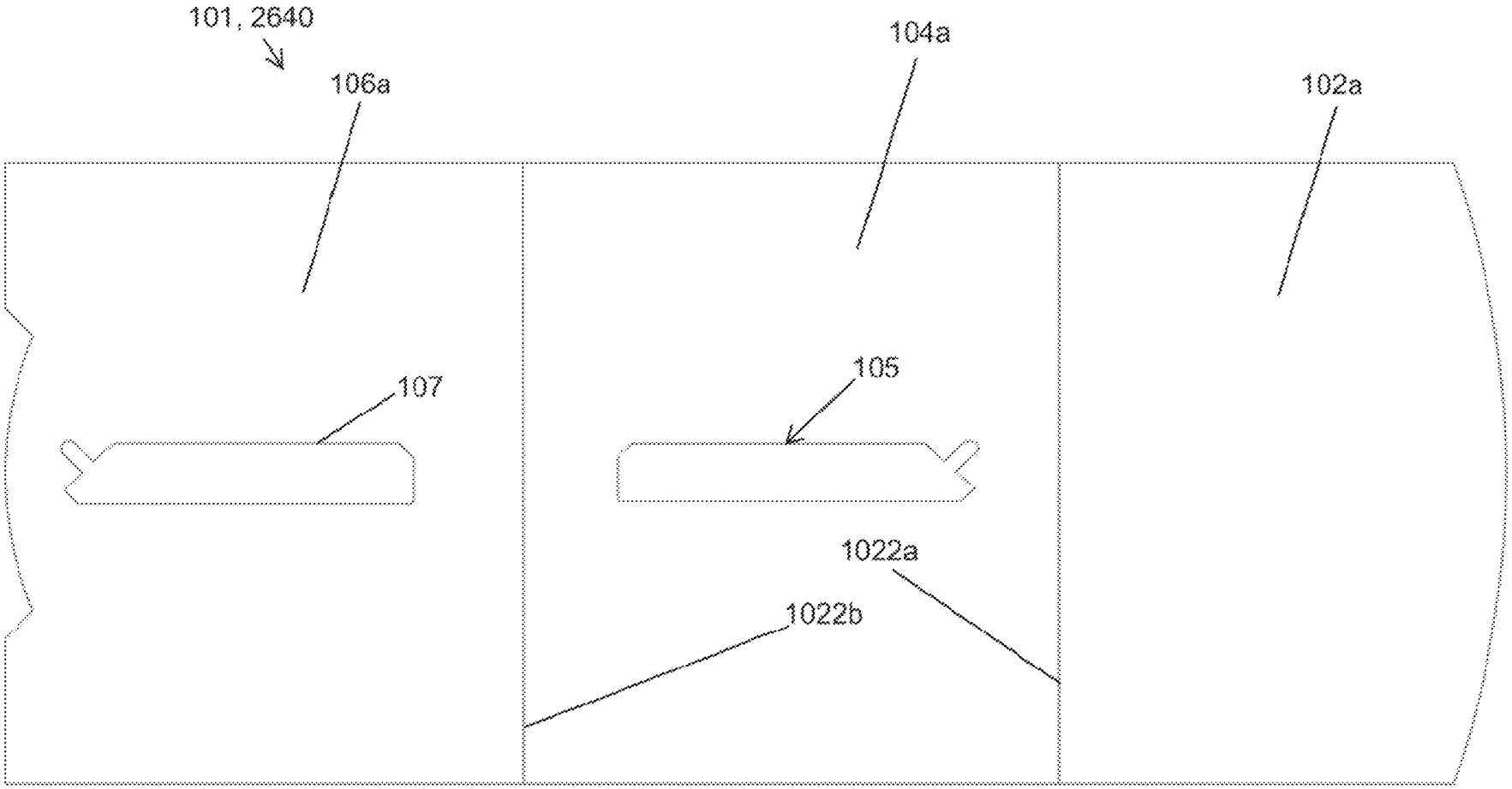
FIG. 16 is an elevational view of the mailer system and illustrates an eighth step 2640 (see flow chart of FIG. 26) in forming the mailer system.

Referring now to FIG. 16, this figure is an elevational view of the mailer system 101 and illustrates an eighth step 2640 (see flow chart of FIG. 26) in forming the mailer system 101. FIG. 16 is substantially similar to FIG. 15. So only the differences between FIG. 16 and FIG. 15 will be described here.

In this FIG. 16, the third section 106*a* has been "opened-up" by unfolding that section 106*a* along fold line 1022*b*. In FIG. 16, all three tri-fold front sections 102*a*, 104*a*, and 106*a* are now visible. The aperture 107 of the first tri-fold section 106*a* is now diametrically opposite to the container 105 which is positioned in the second tri-fold section 104*a*. The container 105 is now ready for removal from the mailer system 101. Specifically, the container 105 may be removed from the mailer system 101 by pulling it away from the front surface 104*a* of section 104 by using a peelable gel glue. And the glue will usually remain on the front surface 104*a* of section 104.

Figure 17:
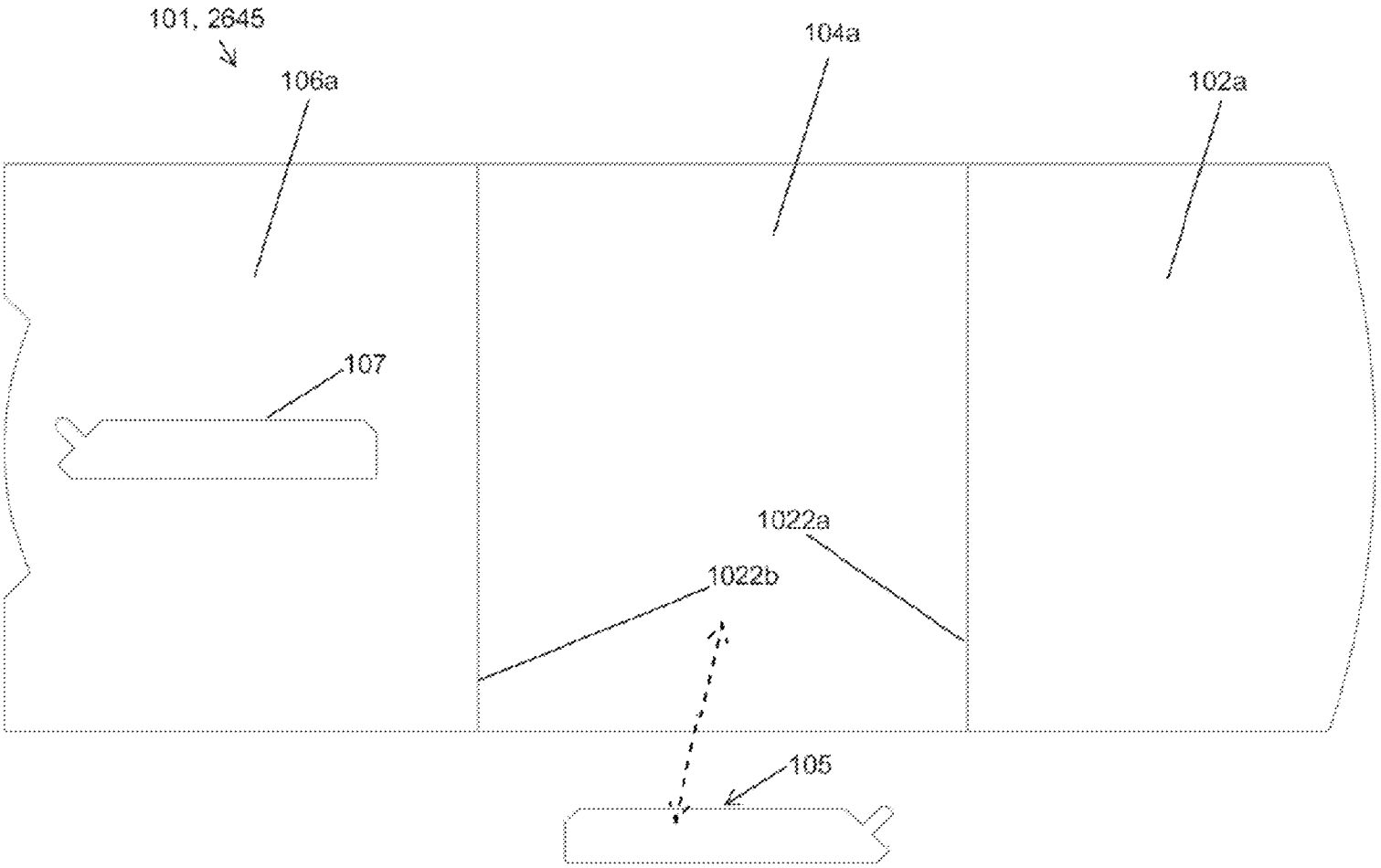
FIG. 17 is an elevational view of the mailer system and illustrates a ninth step 2645 (see flow chart of FIG. 26) in forming the mailer system.

Referring now to FIG. 17, this figure is an elevational view of the mailer system 101 and illustrates a ninth step 2645 (see flow chart of FIG. 26) in forming the mailer system 101. FIG. 17 is substantially similar to FIG. 16. So only the differences between FIG. 17 and FIG. 16 will be described here.

In FIG. 17, the container 105 has been removed from the second section 104*a* of the folded mailer system 101 as illustrated with the dashed-double-headed arrow presented in this figure. The container 105 can now be opened such that its fluid contents may now be used.

Figure 18A:
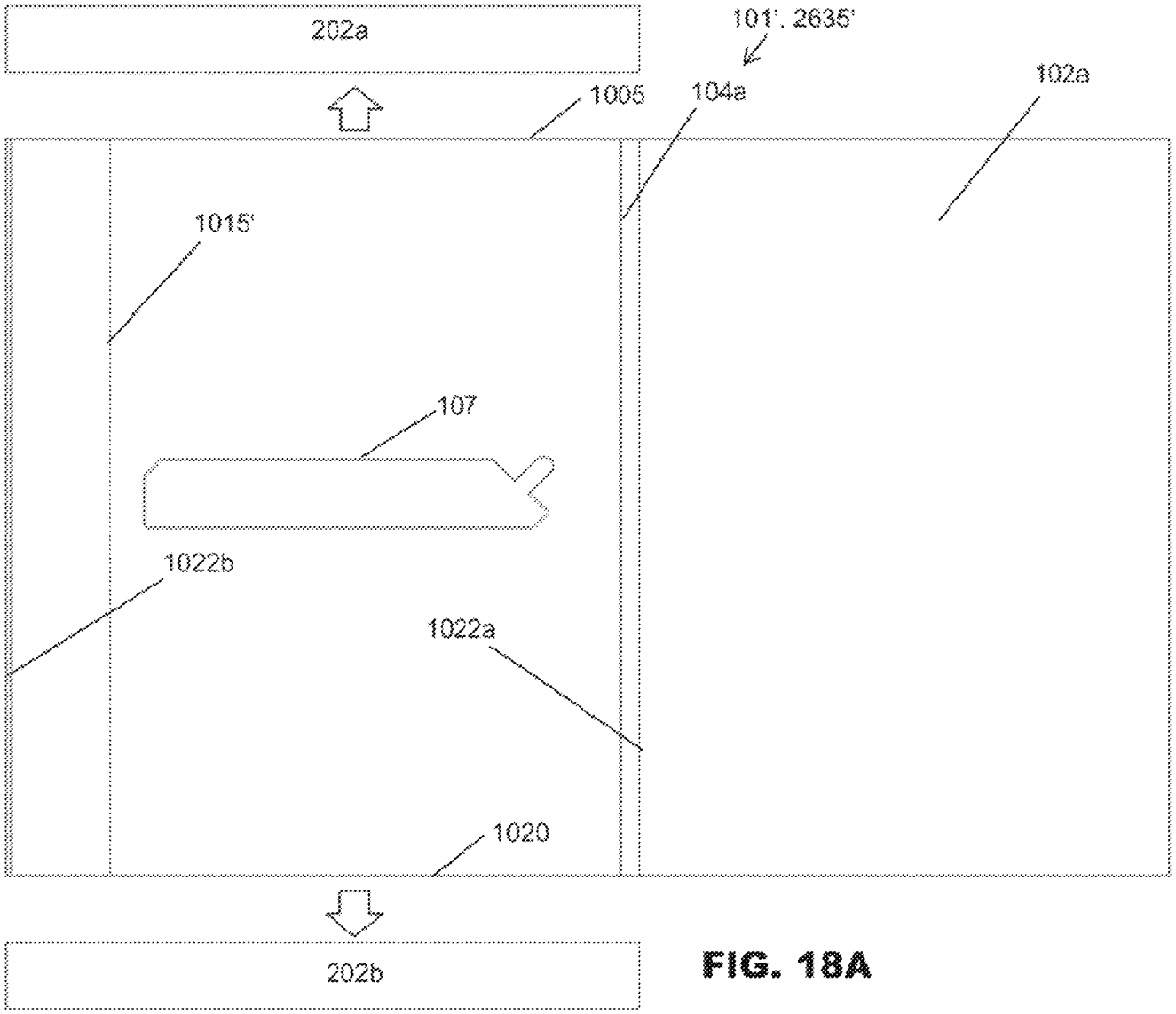
FIG. 18A is an elevational view of the mailer system and illustrates another version/embodiment of the seventh step 2635' (see flow chart of FIG. 26) in forming the mailer system.

Referring now to FIG. 18A, this figure is an elevational view of the mailer system 101 and illustrates another version/embodiment of the seventh step 2635' (see flow chart of FIG. 26) in forming the mailer system 101. FIG. 18A is substantially similar to FIG. 13B. So only the differences between FIG. 18A and FIG. 13B will be described here.

In FIG. 18A, the straight cut-line or perforation line 1015' is visible and it is along this line 1015' that the third section 102*a* was opened-up and unfolded along fold line 1022*a*. While only aperture 107 is shown, the aperture 107 does enclose the container 105 (not shown). Sections 202*a* and 202*b* have been removed along cut-line or perforation lines 1005, 1020.

Figure 18B:
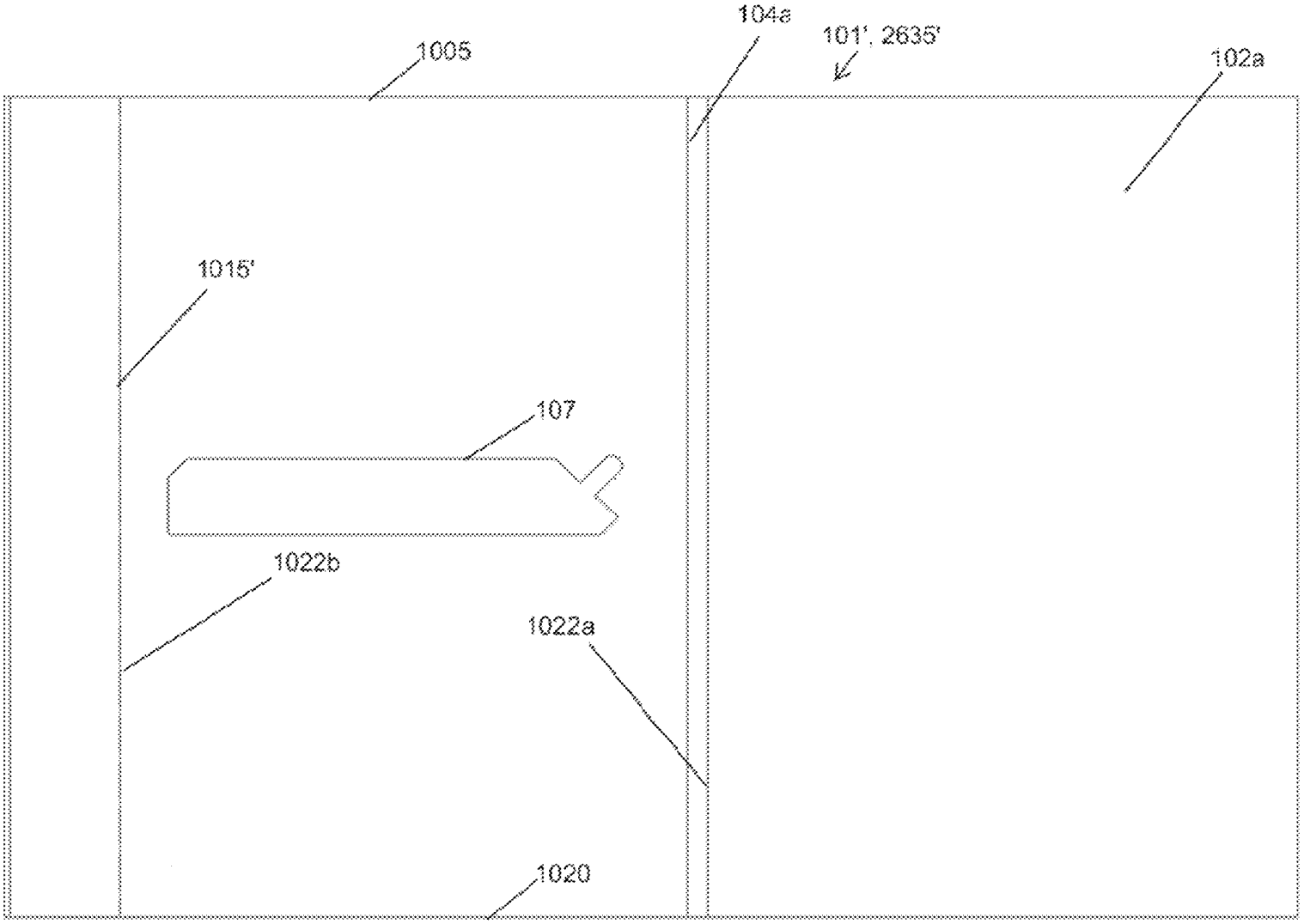
FIG. 18B is an elevational view of the mailer system and illustrates another version/embodiment of the seventh step 2635' of FIG. 26.

Referring now to FIG. 18B, this figure is an elevational view of the mailer system 101 and illustrates another version/embodiment of the seventh step 2635' (see flow chart of FIG. 26) in forming the mailer system 101. FIG. 18B is substantially similar to FIG. 18A. So only the differences between FIG. 18A and FIG. 18B will be described here.

In this FIG. 18B, the two portions 202*a*, 202*b* (seen in FIG. 18A) have been removed along cut-lines or perforation lines 1005, 1020. Like FIG. 18A and FIG. 13B, the cut-line or perforation line 1015' is visible and is straight compared to the cut-line 1015 of FIG. 13A.

Figure 19:
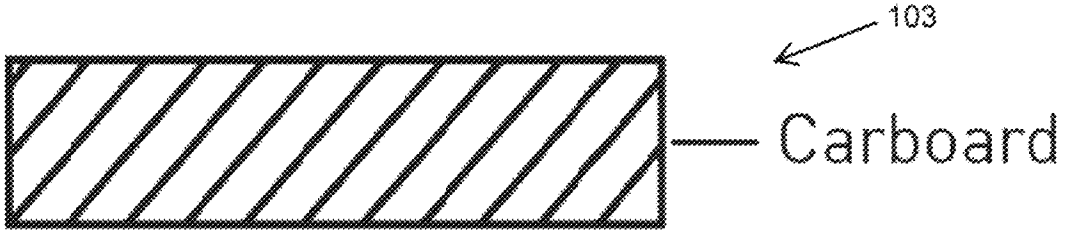
FIG. 19 illustrates how a single layer sheet (unfolded) for the mailer system can be formed from a single layer of cardboard.

FIGS. 19-25 illustrate how a geometric planar sheet for the mailer system 101, which is later folded, can be formed from one or more layers of materials stacked together. Stated differently, as an example, FIG. 19 illustrates how a single layer sheet (unfolded) 103 for the mailer system 101 can be formed from a single layer of cardboard. Alternatively, multiple layers may be combined together to form the geometric planar sheet that is later folded.

Figure 20:
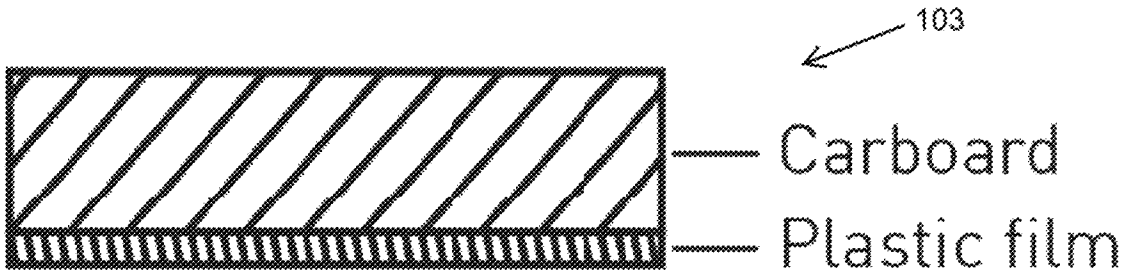
FIG. 20 illustrates a planar sheet for the mailer system can be made from two layers.
Figure 21:
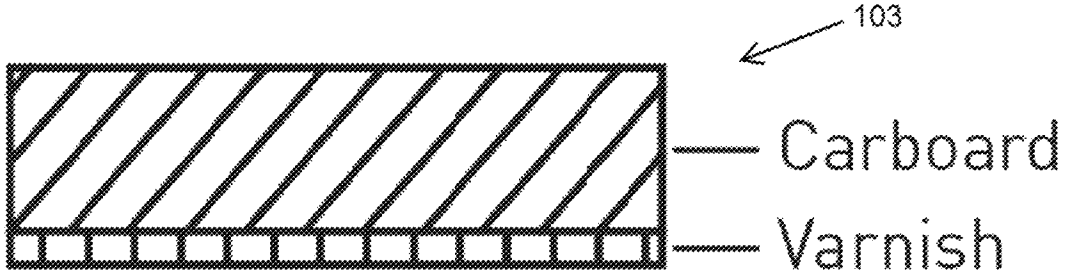
FIG. 21 illustrates a sheet made from two layers for the mailer system.

As but one example, two layers are shown in each of FIGS. 20 and 21. FIGS. 20-21 illustrate how a mailer system 101 (i.e. geometric planar sheet 103 before folding) may be formed from two layers of materials for the geometric planar sheet 103. So in FIG. 20, a planar sheet 103 for the mailer system 101 can be made from two layers: one from cardboard, and one from plastic film. And FIG. 21 illustrates a sheet 103 made from two layers: one from cardboard, and one from varnish. While the exact dimensions of these layers may not be to scale, the relative thickness of the layers may generally correspond to these Figures.

In the multi-layer embodiments, such as illustrated in FIGS. 20-21, the thinner layers such as the plastic film (FIG. 20) and varnish layer (FIG. 21) may form the external sides (i.e. 102*b*, 104*b*, 106*b*-See FIG. 3) of the mailer system 101, while the thicker layers (Cardboard) may form the internal sides (102*a*, 104*a*, 106*a*—see FIG. 2) of the mailer system 101 once folded. The layers may be designed to absorb any liquids that could leak out from the container 105 described above.

Figure 22:
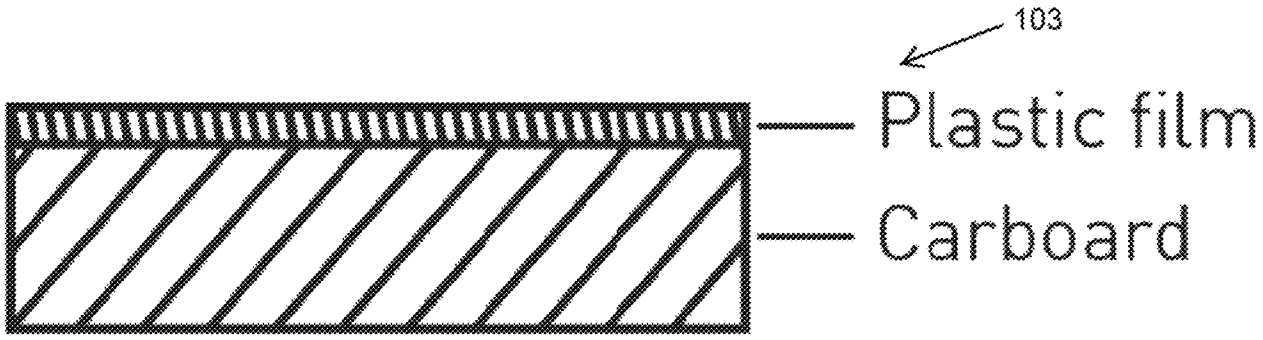
FIG. 22 illustrates a sheet made from two layers for the mailer system.
Figure 23:
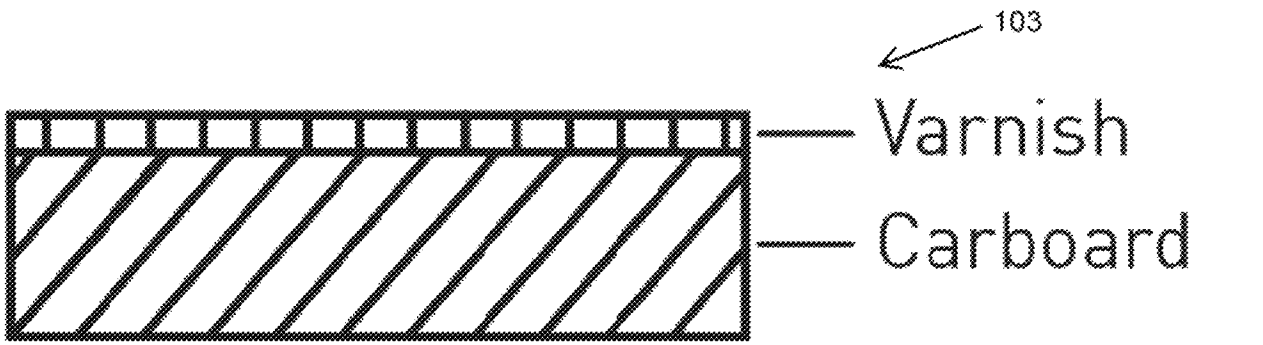
FIG. 23 illustrates a sheet made from two layers for the mailer system.

In the multi-layer embodiments, such as illustrated in FIGS. 22-23, the thinner layers such as the plastic film (FIG. 22) and varnish layer (FIG. 23) may form the internal sides (102*a*, 104*a*, 106*a*—see FIG. 2) of the mailer system 101, while the thicker layers (Cardboard) may form the external layers (i.e. 102*b*, 104*b*, 106*b*-See FIG. 3) of the mailer system 101 once folded. As noted above, each layer may be designed to absorb any liquids that could leak out from the container 105 described above.

Figure 24:
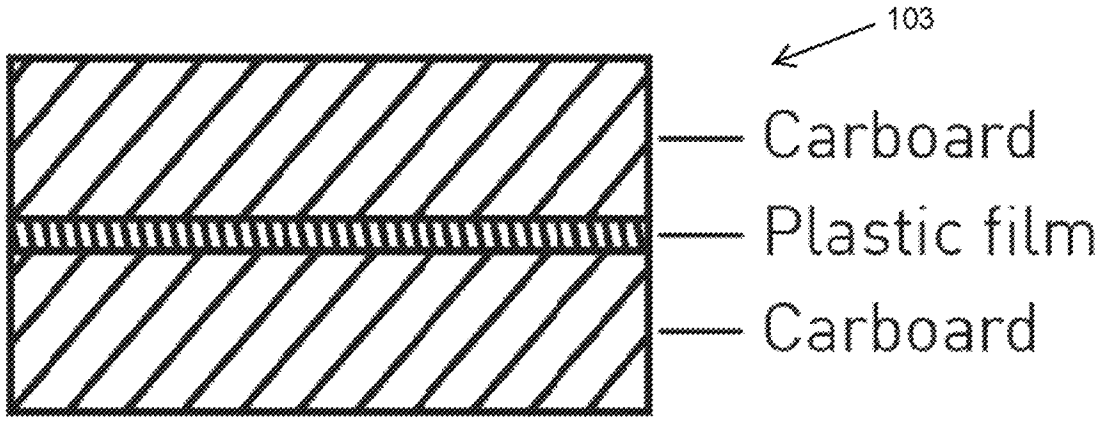
FIG. 24 illustrates a cross-sectional view of a geometric planar sheet for the mailer system made from three layers.

Referring now to FIG. 24, this figure illustrates a cross-sectional view of a geometric planar sheet 103 made from three layers: cardboard, plastic film, and cardboard. While exact dimensions are not illustrated in this FIG. 24 (or the other FIGS. 19-25 showing cross-sections), the proportions or relative thicknesses of the layers may be used to form the geometric planar sheet 103.

Figure 25:
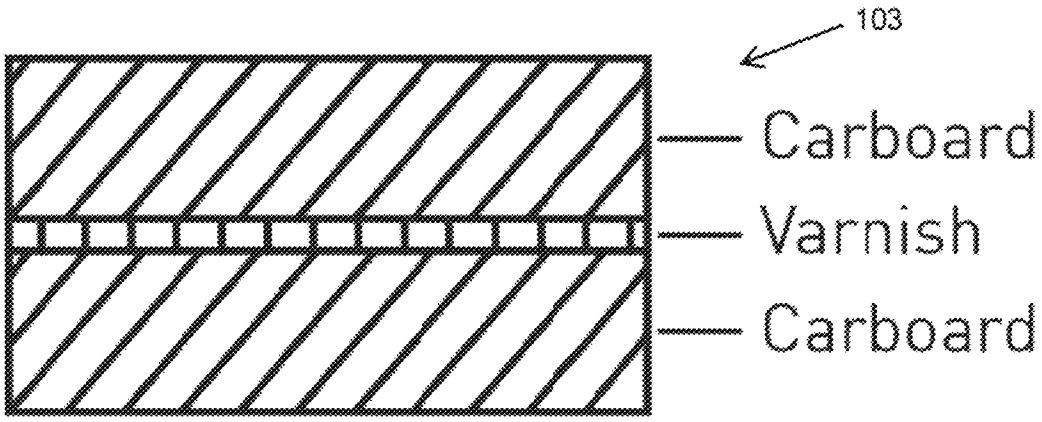
FIG. 25 illustrates another cross-sectional view of a geometric planar sheet made from three layers for the mailer system.

Referring now to FIG. 25, this figure illustrates a cross-sectional view of a geometric planar sheet 103 made from three layers: a single varnish layer sandwiched between two cardboard layers. Other layers and other combinations of the layers suggested by FIGS. 20-25 are possible and are included within the scope of this disclosure.

FIG. 21 illustrates one, preferred exemplary embodiment. In some exemplary embodiments (not illustrated) of FIG. 21, certain areas of the mailer system 101 may not have any varnish so that inks may be applied on the external sides of the folded mailer system 101 so that mailing address information may be printed on the surface.

Figure 26:
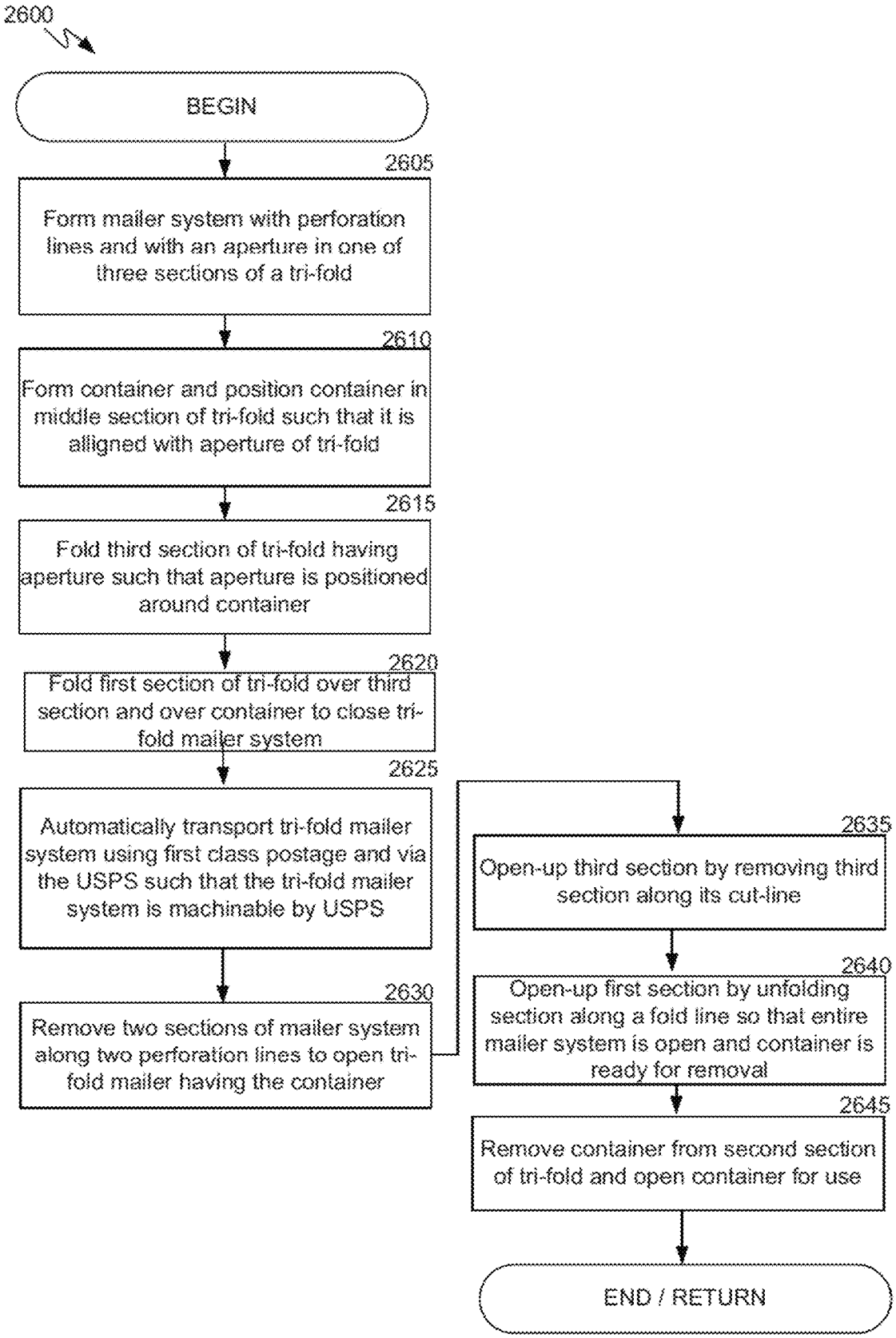
FIG. 26 illustrates a flow chart for a method for forming a folded mailer system that corresponds with FIGS. 10-18B.

Referring now to FIG. 26, this figure illustrates a flow chart for a method 2600 for forming a folded mailer system 101 that corresponds with FIGS. 10-18B described above. Step 2605 is the first step of method 2600. In step 2605, the mailer system 101 of FIGS. 1-25 is formed with perforation lines 1005, 1015, 1020 and with an aperture 107 in one of three sections 102, 104, 106 of a tri-folded system 101.

As understood by one of ordinary skill in the art, the mailer system 101 could be formed by folding a sheet in any number of folds as well as without any folding. That is, the system 101 could be formed as a bi-fold (two-folded) system 101. Alternatively, the system 101 could be formed as a quad-fold (four-folded) system as well, and so-on. And it follows that the system 101 may also work without any folds (single sheet-no folds) as understood by one of ordinary skill in the art.

In step 2605, perforation lines 1005, 1015, and 1020 are formed within the system 101 as illustrated in FIG. 10 described above. This allows for sections 202*a*-202*g* to removed later. Any number of perforation lines 1005, 1015, 1020 may be formed as desired to allow for opening of the mailer system 101 as understood by one of ordinary skill in the art. Also in step 2605, an aperture 107 is formed in section 106 of the tri-fold system 101 for receiving the container 105. Depending on the number of folds used or not used, the formation of the aperture 107 step may be skipped in alternative exemplary embodiments that are within the scope of this disclosure.

Subsequently, in second step 2610 of FIG. 26, the container 105 is formed and positioned in a middle section 104 of the tri-fold system 101 as illustrated in FIG. 11 so that it will align with the aperture 107 in the end section 106 of the tri-fold. As noted previously, it is recognized that the mailer system 101 may be formed by any number of folds or without folds as desired. Therefore, this second step 2610 may be changed and/or skipped depending on the number of folds in the mailer system 101.

Next, in third step 2615, the third section 106 of the tri-fold mailer system 101 is folded along the fold line 1022*b* such that the aperture 107 aligns with the perimeter of the container 105, as illustrated in FIG. 12. As noted previously, the perimeter of the aperture 107 is slightly larger than the perimeter of the container 105 so that the aperture 107 receives the entire perimeter of the container 105. FIG. 12 illustrates this third step 2615 and how the third section of the tri-fold has been folded along the fold line 1022*b* so that its back side 106*b* is now visible and is positioned on top of the front side 104*a* of the second section 104.

Subsequently, in the fourth step 2620 of FIG. 26, the first section 102 of the tri-fold mailer system 101 is folded along fold line 1022*a* to close the tri-fold mailer system 101 as illustrated in FIGS. 12-13A/13B. As noted previously, FIG. 13A illustrates a first exemplary embodiment where cut-line 1015 has a straight or linear geometry. Meanwhile, FIG. 13B illustrates a second exemplary embodiment where the cut-line 1015' has a curved geometry. This demonstrates that cut-lines and/or fold lines may be formed with any number of geometries without departing from this disclosure.

Next, in step 2625 of FIG. 26, the tri-fold mailer system 101 may be automatically transported/mailed/processed using first class postage and via the USPS such that the tri-fold mailer system 101 is "machinable" by the USPS. This step 2625 generally corresponds with FIG. 8 which illustrates how the mailer system 101 is flexible and may be bent around the drum 800 and belt 810 in an automated mailing system, as understood by one of ordinary skill in the art.

The sections 102, 104, 106 and container 105 of the system 101 have a predetermined flexibility such that they may be bent around the drum 800 as described above. Thus, in this fifth step 2625 of method 2600, the mailer systems 101, 101' are flexible or bendable around drums 800 illustrated in FIG. 8 during automated sorting used by the USPS, and other jurisdictions/entities.

Subsequently, in the sixth step 2630, the mailer system 101 has been received by the consumer located at the mailing address 1404 (seen in FIG. 14). And the consumer may now open the mailer system 101 by removing two sections 202*a*, 202*b* along perforation lines 1005, 1020 as shown in FIG. 14.

Next, in the seventh step 2635, the third section 102*a* of the tri-fold as illustrated in FIG. 15 has been "opened-up" by opening 102*a* along the curved cut-line 1015 and unfolding it along fold line 1022*a*. The inside third section 102*a* and inside second section 104*a* are now visible in FIG. 15. The outside first section 106*b* is also visible in FIG. 15.

In the eighth step 2640, the third section 106*a* may be "opened-up" by unfolding that section 106*a* along fold line 1022*b* as illustrated in FIG. 16. In FIG. 16, all three tri-fold front sections 102*a*, 104*a*, and 106*a* are now visible. The aperture 107 of the first tri-fold section 106*a* is now diametrically opposite to the container 105 which is positioned in the second tri-fold section 104*a*. The container 105 is now ready for removal from the mailer system 101 (and particularly, from the surface of the front portion 104*a* of section 104).

Next, in the ninth step 2645, the container 105 may be removed from the second section 104*a* of the folded mailer system 101 as illustrated with the dashed-double-headed arrow presented in FIG. 17. Specifically, as noted previously, the container 105 may be removed from the mailer system 101 by pulling it away from the front surface 104*a* of section 104 by using a peelable gel glue. And the glue will usually remain on the front surface 104*a* of section 104. Once removed from the mailer system 101, the container 105 of FIG. 17 can now be opened such that its contents may now be used by a consumer. The method/process 2600 may then return/repeat as needed and understood by one of ordinary skill in the art.

Referring now to FIG. 27A, this figure illustrates a top view of the container 105' according to an alternative exemplary embodiment of the mailer system 101. As noted previously, the container 105' has an end portion 507. The container 105 further has a bottom plate 511 where the end portion 507 is coupled to this bottom plate 511. The bottom plate 511 further has an edge 509. FIG. 27A, like FIG. 5A, also shows various exemplary dimensions in mm shown between double headed arrows. Other dimensions are possible and are included within the scope of this disclosure.

Referring now to FIG. 27B, this figure illustrates a side view of the container illustrated in FIG. 27A according to the alternative exemplary embodiment and corresponds with FIG. 27A. According to this exemplary embodiment of FIGS. 27A & 27B, the distance between the end portion 507 and the edge 509 of the bottom plate 511 is approximately 11.5 mm. Compare this to the exemplary embodiment shown in FIGS. 5A-5B: in that embodiment, the distance between the end portion 507 and the edge 509 of the bottom plate 511 is approximately 5.5 mm.

Additionally, certain steps in the processes or process flows enabled by the mechanical drawings in this specification naturally precede others for the invention to function as described. However, the invention is not limited to the order of the steps described if such order or sequence does not alter the functionality of the invention. That is, it is recognized that some steps may performed before, after, or parallel (substantially simultaneously with) other steps without departing from the scope and spirit of the invention. In some instances, certain steps may be omitted or not performed without departing from the invention.

The materials for the parts illustrated in the several figures may include various types of polymers/plastics like silicone as well as compostable plant based resin films. Other plastics than those described above may be employed without departing from the scope of this disclosure. Further, other materials besides plastics are also possible and are included within the scope of this disclosure. Other materials besides plastics include, but are not limited to, composite materials, and any combination thereof.

Although a few embodiments have been described in detail above and illustrated in the several figures, those skilled in the art will readily appreciate that many modifications from those which were described and as illustrated are possible in the embodiments without materially departing from this disclosure. Accordingly, such modifications are intended to be included within the scope of this disclosure as defined in the following claims.

For example, while several mechanical configurations are illustrated in FIGS. 1-25, it is possible that these mechanical configurations may be replaced/substituted by additional and/or fewer structures. Further, mechanical equivalents of any of the illustrated structures could be substituted for many of the structures illustrated in the several views as understood by one of ordinary skill in the art. Such substitutions of mechanical equivalent structures are included within the scope of this disclosure.

Similarly, in the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

It is the express intention of the applicant not to invoke 35 U.S.C. § 112, sixth paragraph for any limitations of any of the claims herein (or in future cases), except for those in which the claim expressly uses the words 'means for' together with an associated function.

The following numbered clauses are also part of the disclosure and are comprised by the spirit and scope of the present invention:

1. A mailer system comprising:
   a container for holding a liquid;
   a structure for holding the container when the container is shipped, the structure comprising at least two sections which are folded on to each other when the container is shipped, wherein the container and structure are machinable within an automated mailing system.
2. The system of clause 1, wherein one section of the structure has an aperture for receiving the container.
3. The system of clauses 1 or 2, wherein the structure comprises a third section which is folded over the first and second sections.
4. The system of any of clauses 1 to 3, wherein the structure comprises a tri-folded arrangement when the container and structure are shipped.
5. The system of any of clauses 1 to 4, wherein each section has removable portions that are detached after the container and structure are shipped such that the container may be removed from the structure.
6. The system of any of clauses 1 to 5, wherein the container has a fluid outlet.
7. The system of any of clauses 1 to 6, wherein the container holds a fluid comprising at least one of:
   a fragrance, a pheromone, a cosmetic treatment, an insecticide, a parasiticide, and a pharmaceutical compound for treating an animal or a human.
8. The system of any of clauses 1 to 7, wherein the container has a bottom plate.
9. The system of any of clauses 1 to 8, wherein the structure comprises a planar sheet.
10. The system of any of clauses 1 to 9, wherein the planar sheet comprises a plurality of layers.
11. A mailer system comprising:
    a folded planar member;
    a container that is attached to the folded planar member, the container enclosing a dosage form, wherein the mailer system is machinable by an automated mailing system which uses at least one drum that bends the mailer system around the drum.
12. The system of clause 11, wherein the dosage form comprises a topical composition for the treatment or prevention of an ectoparasitic infestation in animals.
13. The system of clause 11 or 12, wherein the ectoparasites comprise at least one of fleas, ticks, chewing lice, and mange.
14. The system of any of clauses 11 to 13, wherein the dosage form comprises at least one of: a fragrance, a pheromone, a cosmetic treatment, an insecticide, and a pharmaceutical.
15. The system of any of clauses 11 to 14, wherein the folded planar member comprises a plurality of layers.
16. The system of any of clauses 11 to 15, wherein one layer comprises at least one of cardboard, varnish, and a plastic film.
17. A mailer system comprising:
    a folded planar member;
    a container that is attached to the folded planar member, the container enclosing a dosage form, the folded planar member further comprising an aperture for receiving the container, wherein the mailer system is machinable by an automated mailing system which uses at least one drum that bends the mailer system around the drum.

18. The system of clause 17, wherein the dosage form comprises a topical composition for the treatment or prevention of an ectoparasitic infestation in animals.

19. The system of clause 17 or 18, wherein the ectoparasites comprise at least one of fleas, ticks, chewing lice, and mange.

20. The system of any of clauses 17 to 19, wherein the dosage form comprises at least one of: a fragrance, a pheromone, a cosmetic treatment, an insecticide, and a pharmaceutical.

Although selected aspects have been illustrated and described in detail, it will be understood that various substitutions and alterations may be made therein without departing from the spirit and scope of the present invention, as defined by the following claims.

What is claimed is:

1. A mailer system comprising: a container having a first geometry with a first perimeter for holding a liquid, the container having a fluid outlet that is opened by cutting a portion of the fluid outlet after shipment, the container having a length dimension and a width dimension, the fluid outlet being positioned at an angle relative to the length dimension;

a structure for holding the container when the container is shipped, the structure comprising a first section, a second section, and a third section which are folded on to each other when the container is shipped, wherein the container and structure are machinable within an automated mailing system, the third section comprising an aperture in a geometric center of the third section, the aperture aligns and receives the first perimeter of the container when the second and third sections are folded on to each other such that the aperture holds the container within the geometric center of the third section and second section, the aperture comprising a second geometry that mirrors the first geometry of the container, the second geometry comprising a portion mirroring a shape of the fluid outlet; the aperture comprising a second perimeter that is larger than the first perimeter of the container;

each section having removable portions that are detached after shipment of the container and structure such that the container may be removed from the structure after the removable portions are detached from the structure after shipment.

2. The system of claim 1, wherein the structure comprises the third section which is folded over the first and second sections.

3. The system of claim 1, wherein the structure comprises a tri-folded arrangement when the container and structure are shipped.

4. The system of claim 1, wherein the container holds a fluid comprising at least one of: a fragrance, a pheromone, a cosmetic treatment, an insecticide, a parasiticide, and a pharmaceutical compound for treating an animal or a human.

5. The system of claim 1, wherein the container has a bottom plate.

6. The system of claim 1, wherein the structure comprises a planar sheet.

7. The system of claim 1, wherein the structure comprises a plurality of layers.

8. A mailer system comprising:

a folded planar member;

a container having a first geometry with a first perimeter that is attached to the folded planar member, the container having a dosage outlet that is opened by cutting a portion of the dosage outlet after shipment, the container enclosing a dosage form, the container having a length dimension and a width dimension, the dosage outlet being positioned at an angle relative to the length dimension;

the folded planar member comprising a first section, a second section, and a third section which are folded on to each other when the container is shipped, the third section comprising an aperture in a geometric center of the third section, the aperture aligns and receives the first perimeter of the container when the second section and third sections are folded on to each other such that the aperture holds the container within the geometric center of the third section and second section, the aperture comprising a second geometry that mirrors the first geometry of the container, the second geometry comprising a portion mirroring a shape of the dosage outlet; the aperture comprising a second perimeter that is larger than the first perimeter of the container, each section of the folded planar member having removable portions that are detached after shipment of the container and folded planar member such that the container may be removed from the folded planar member after the removable portions are detached from the folded planar member after shipment;

wherein the mailer system is machinable by an automated mailing system which uses at least one drum that bends the mailer system around the drum.

9. The system of claim 8, wherein the dosage form comprises a topical composition for the treatment or prevention of an ectoparasitic infestation in animals.

10. The system of claim 8, wherein the topical composition treats or prevents infestation of at least one of: fleas, ticks, chewing lice, and mange.

11. The system of claim 8, wherein the dosage form comprises at least one of: a fragrance, a pheromone, a cosmetic treatment, an insecticide, and a pharmaceutical.

12. The system of claim 8, wherein the folded planar member comprises a plurality of layers.

13. The system of claim 12, wherein one layer comprises at least one of cardboard, varnish, and a plastic film.

14. A mailer system comprising:

a folded planar member;

a container having a first geometry with a first perimeter that is attached to the folded planar member, the container enclosing a dosage form, the container having a dosage outlet that is opened by cutting a portion of the dosage outlet after shipment, the container having a length dimension and a width dimension, the length dimension being greater than the width dimension, the dosage outlet being positioned at an angle relative to the length dimension; the folded planar member further comprising an aperture for receiving the container, and the folded planar member having first section, a second section, and third section which are folded on to each other when the container is shipped, the third section having the aperture in a geometric center of the third section, the aperture aligns and receives the first perimeter of the container when the third section and second section are folded on to each other such that the aperture holds the container within the geometric center of the third section and second section, the aperture comprising a second geometry that mirrors the first geometry of the container, the second geometry comprising a portion mirroring a shape of the dosage outlet; the aperture comprising a second perimeter that is larger than the first perimeter of the container; each section of the folded planar member having removable portions that are detached after shipment of the container and folded planar member such that the container may be removed from the folded planar member after the removable portions are detached from the folded planar member after shipment;

wherein the mailer system is machinable by an automated mailing system which uses at least one drum that bends the mailer system around the drum.

15. The system of claim 14, wherein the dosage form comprises a topical composition for the treatment or prevention of an ectoparasitic infestation in animals.

16. The system of claim 14, wherein the topical composition treats or prevents infestation of at least one of: the ectoparasitic infestation comprises at least one of fleas, ticks, chewing lice, and mange.

17. The system of claim 14, wherein the dosage form comprises at least one of: a fragrance, a pheromone, a cosmetic treatment, an insecticide, and a pharmaceutical.

* * * * *